US010683989B2

(12) United States Patent
Choi et al.

(10) Patent No.: US 10,683,989 B2
(45) **Date of Patent: *Jun. 16, 2020**

(54) REFRIGERATOR

(71) Applicant: LG Electronics Inc., Seoul (KR)

(72) Inventors: Changbong Choi, Seoul (KR); Hyesun Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/585,861

(22) Filed: Sep. 27, 2019

(65) Prior Publication Data

US 2020/0025353 A1 Jan. 23, 2020

Related U.S. Application Data

(63) Continuation of application No. 16/035,174, filed on Jul. 13, 2018, now Pat. No. 10,429,032.

(30) Foreign Application Priority Data

Jul. 14, 2017 (KR) ..... 10-2017-0089518

(51) Int. Cl.

| | |
|---|---|
| ***F21V 7/06*** | (2006.01) |
| ***F25D 23/06*** | (2006.01) |
| ***F21V 15/01*** | (2006.01) |
| ***F21V 7/00*** | (2006.01) |
| ***F21V 7/28*** | (2018.01) |
| ***F25D 27/00*** | (2006.01) |
| *F21W 131/305* | (2006.01) |
| *F21Y 103/10* | (2016.01) |
| *F21Y 115/10* | (2016.01) |

(52) U.S. Cl.

CPC ..... *F21V 7/06* (2013.01); *F21V 7/0008* (2013.01); *F21V 7/0066* (2013.01); *F21V 7/28* (2018.02); *F21V 15/01* (2013.01); *F25D 23/065* (2013.01); *F25D 27/00* (2013.01); *F21V 2200/20* (2015.01); *F21W 2131/305* (2013.01); *F21Y 2103/10* (2016.08); *F21Y 2115/10* (2016.08)

(58) Field of Classification Search

CPC ..... F21V 7/0008; F21V 7/0066; F21V 7/06; F21V 7/28; F21V 15/01; F25D 23/065; F25D 27/00

See application file for complete search history.

(56) References Cited

U.S. PATENT DOCUMENTS

2013/0027906 A1* 1/2013 Ueda ..... F25D 27/00 362/92
2018/0017317 A1* 1/2018 Adachi ..... F21K 9/64

* cited by examiner

*Primary Examiner* — Thomas M Sember
(74) *Attorney, Agent, or Firm* — Fish & Richardson P.C.

(57) ABSTRACT

A refrigerator apparatus includes a case opening passing through an inner case; and an lighting device in the opening, wherein the device includes: a lamp case having a cavity defined therein; a light-emitting unit accommodated in the cavity, wherein the light-emitting unit is disposed more outwardly than the case opening, wherein the light-emitting unit irradiates light toward an inner surface of the cavity; a cover coupled with the lamp case to cover the case opening, wherein light from the light-emitting unit is reflected from the cavity through the cover toward the refrigerator interior space; and a reflection portion formed on the cover, wherein the reflection portion is configured to allow light from the light-emission unit directed toward the case opening to be redirected toward the inner surface of the cavity.

20 Claims, 14 Drawing Sheets

【Figure 1】
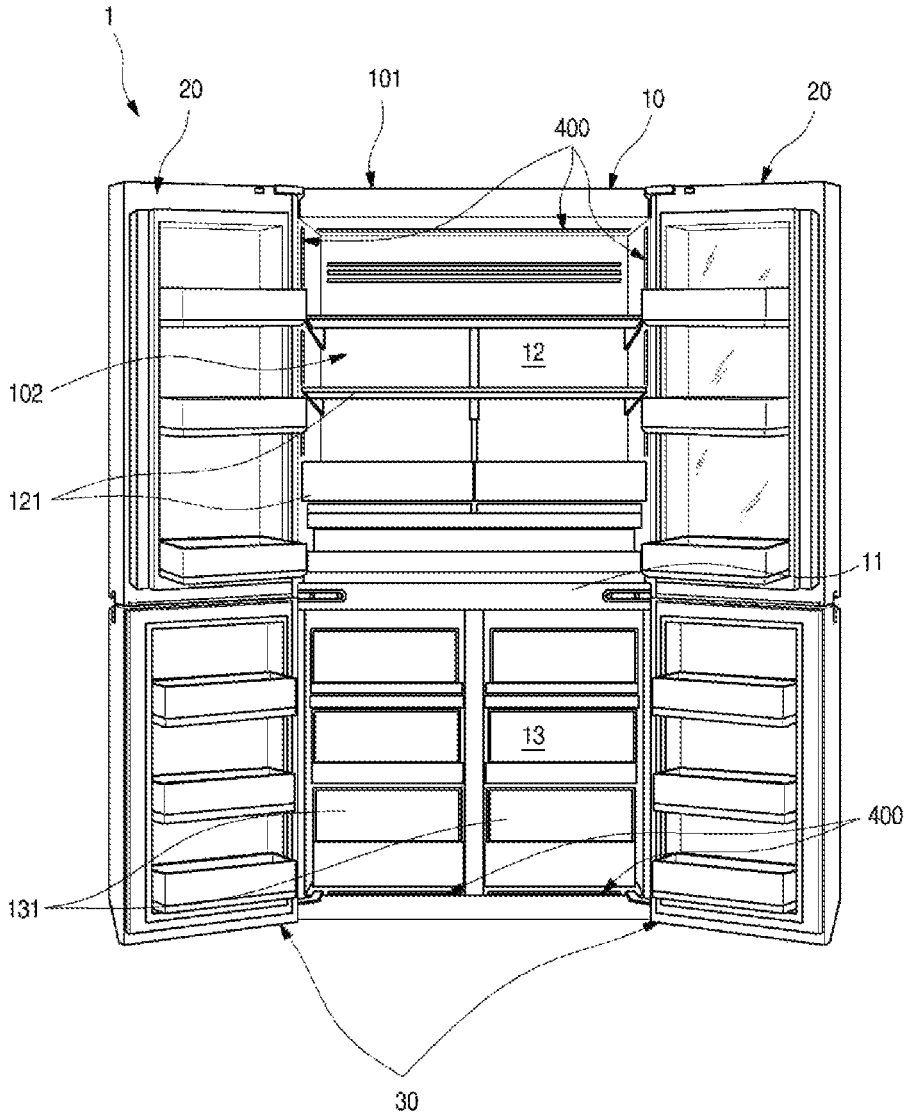

【Figure 2】
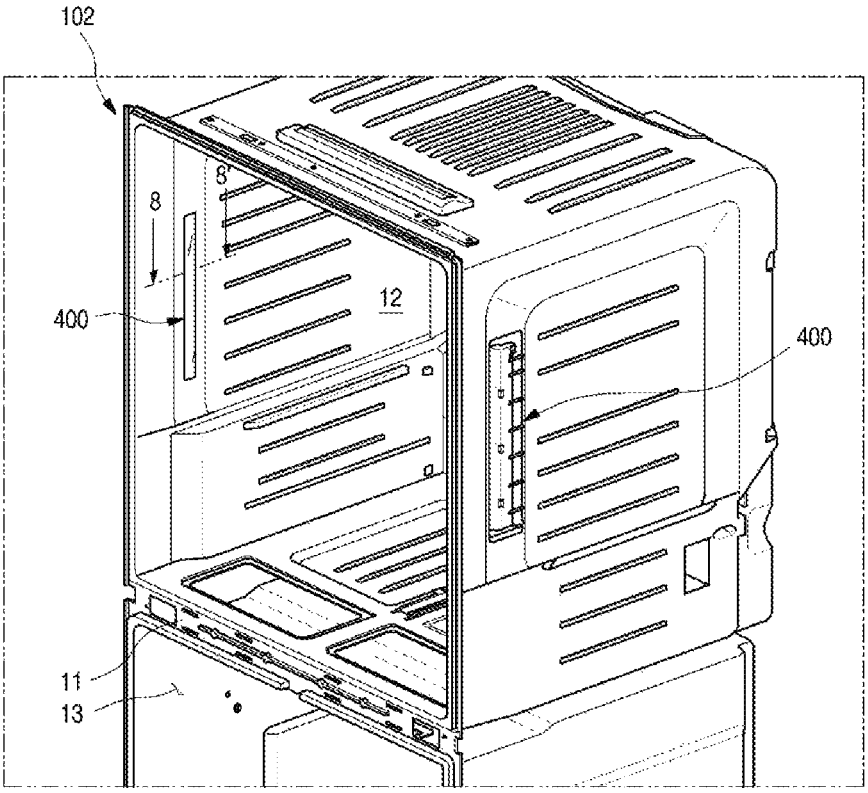

【Figure 3】
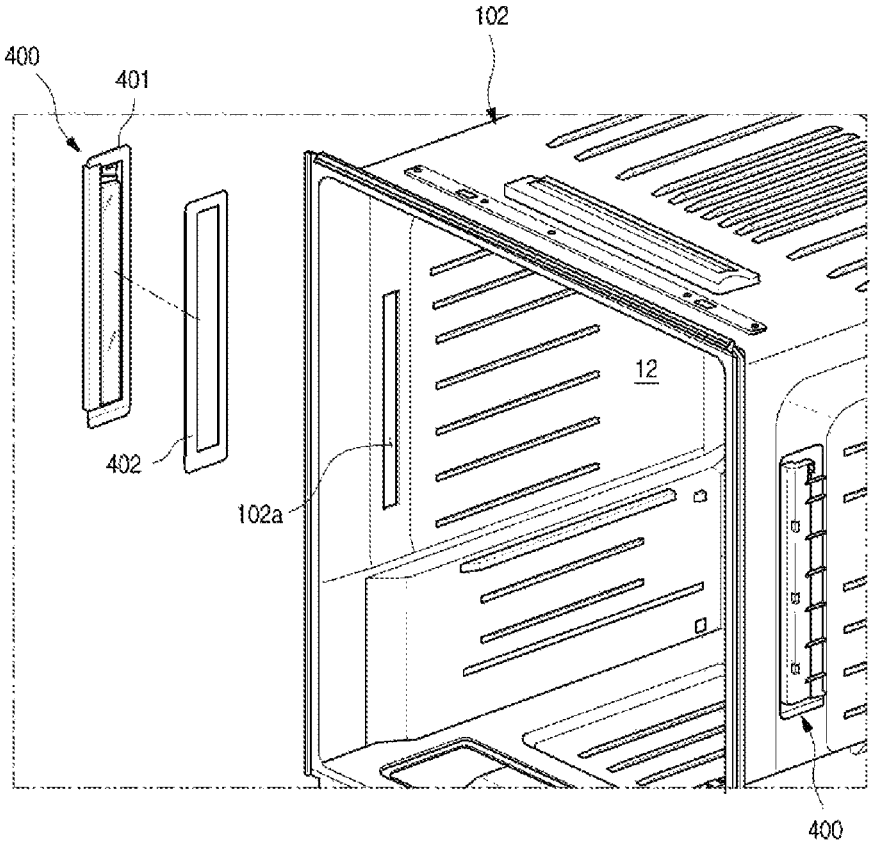

【Figure 4】
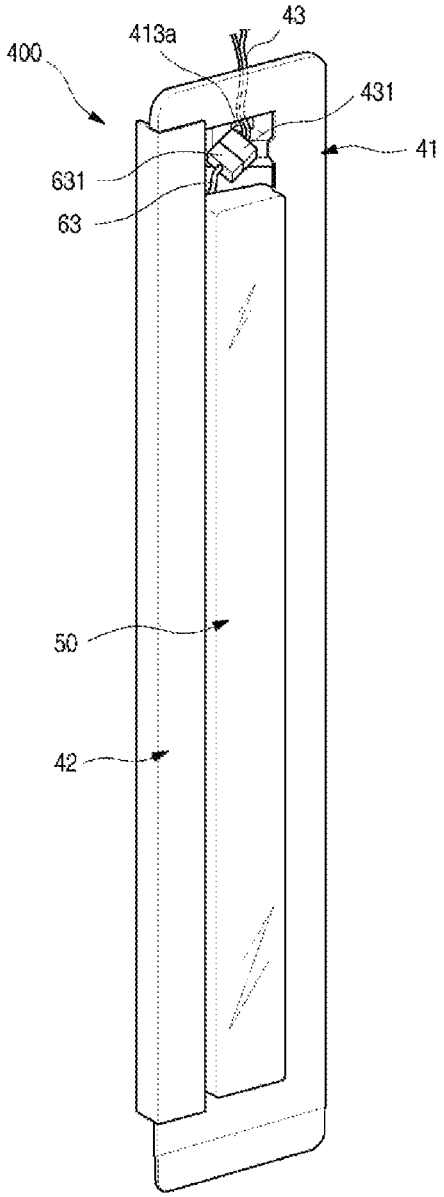

【Figure 5】
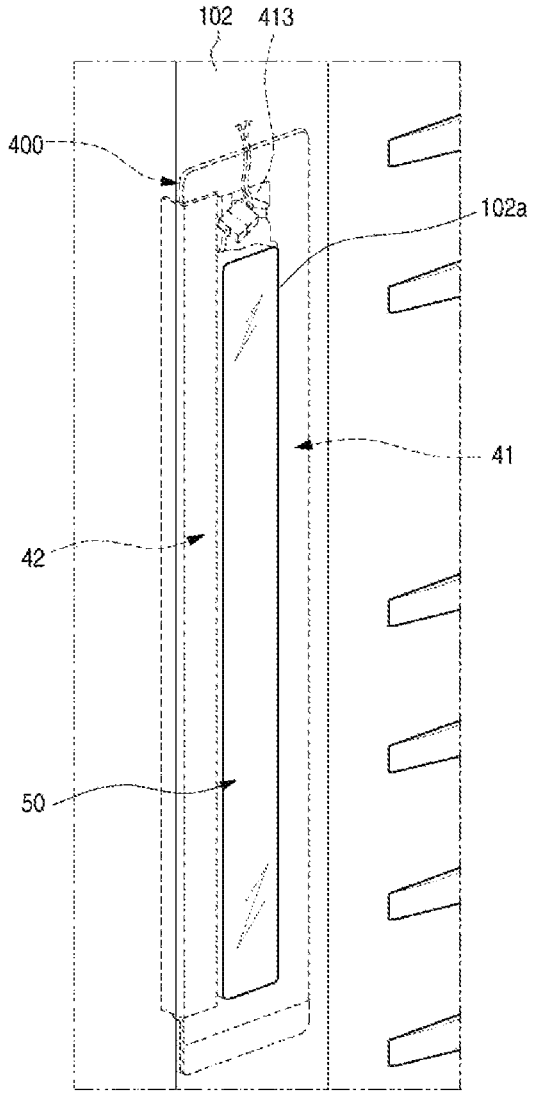

【Figure 6】
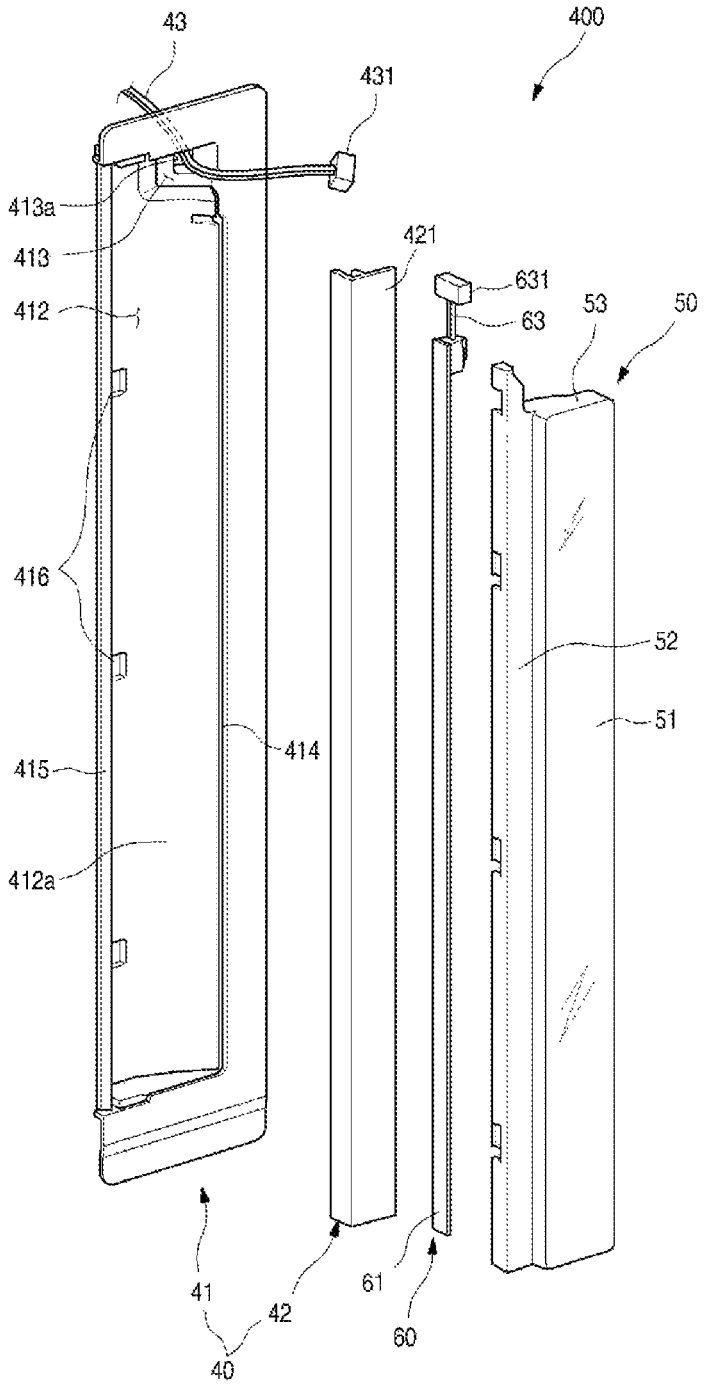

【Figure 7】
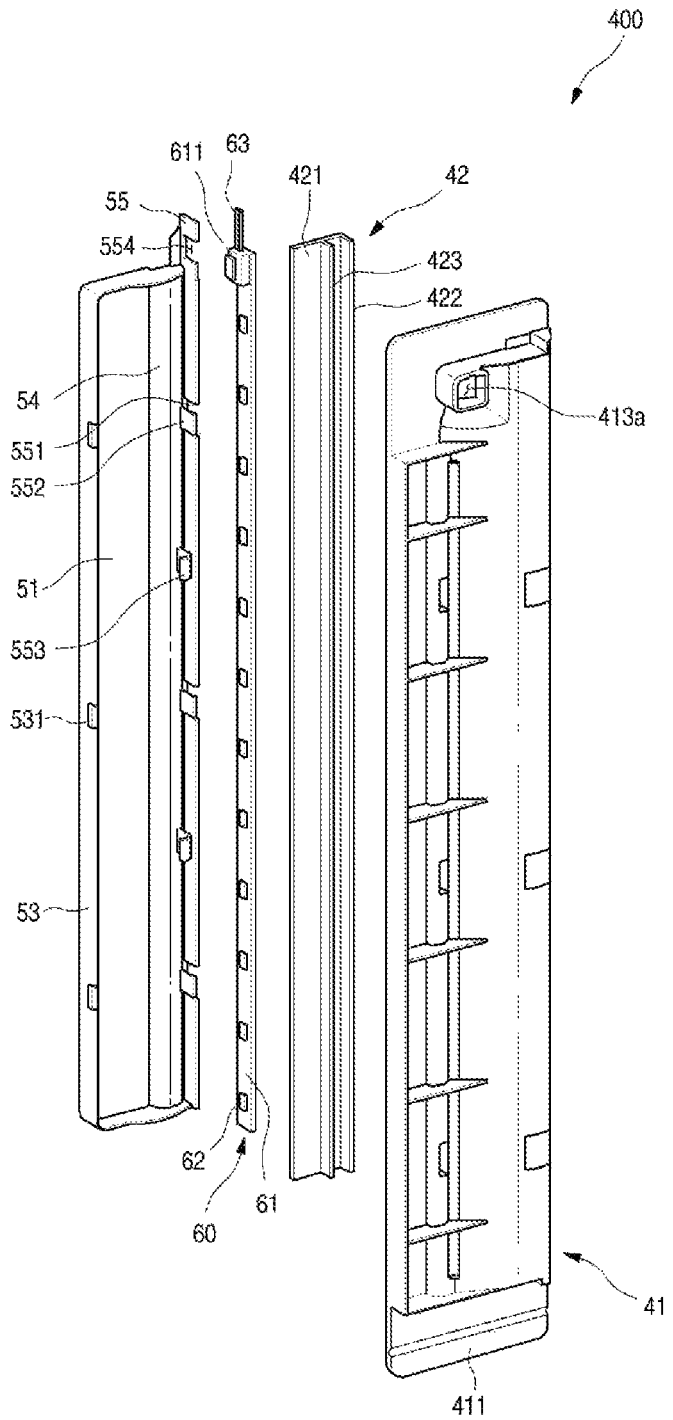

【Figure 8】
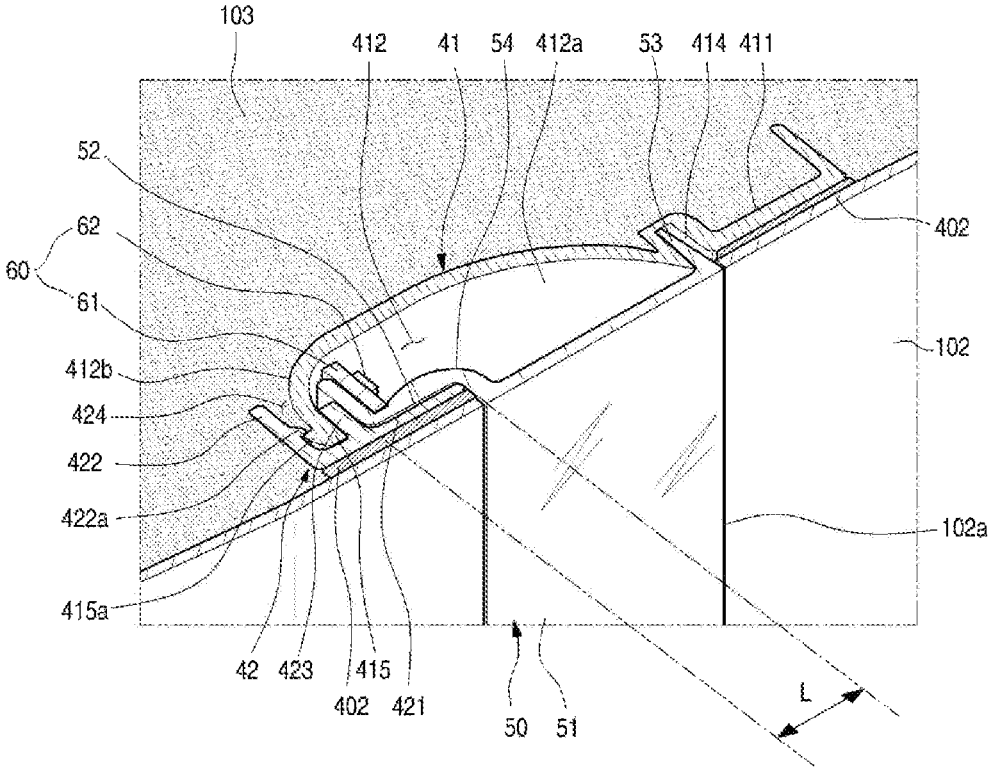

【Figure 9】
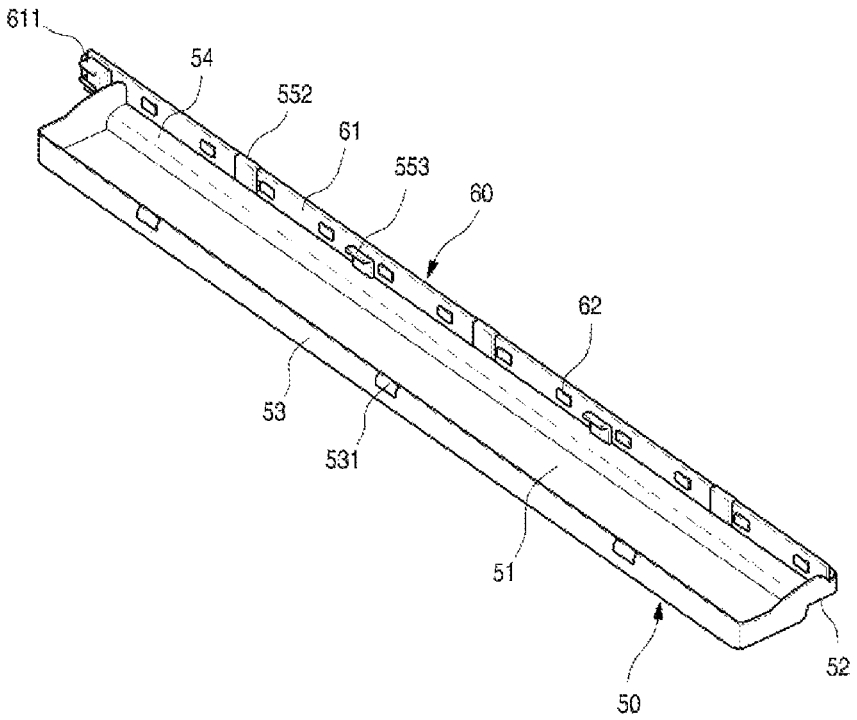

【Figure 10】
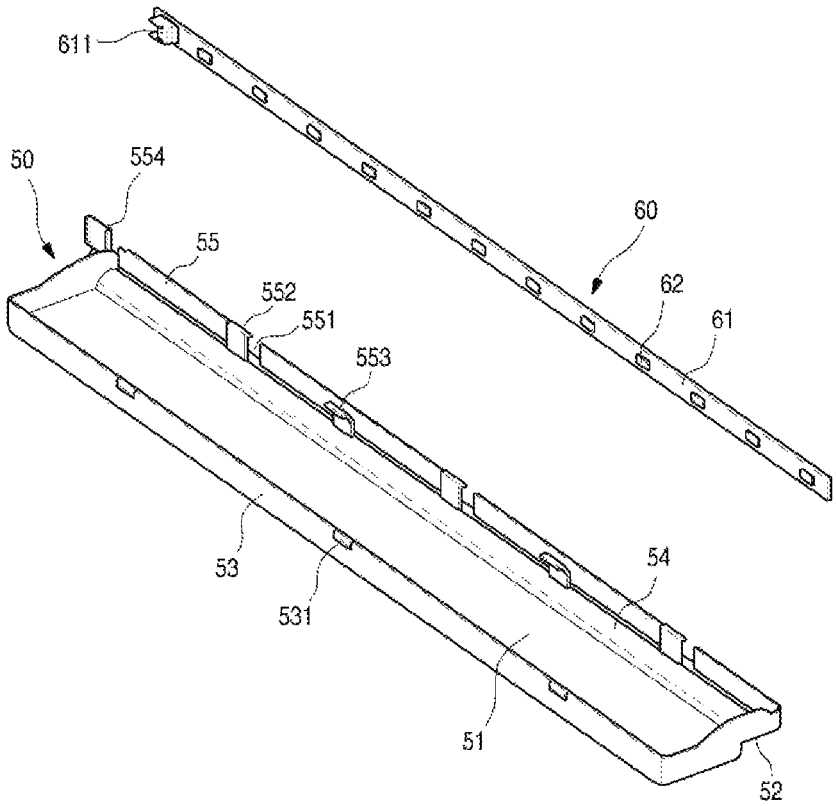

【Figure 11】
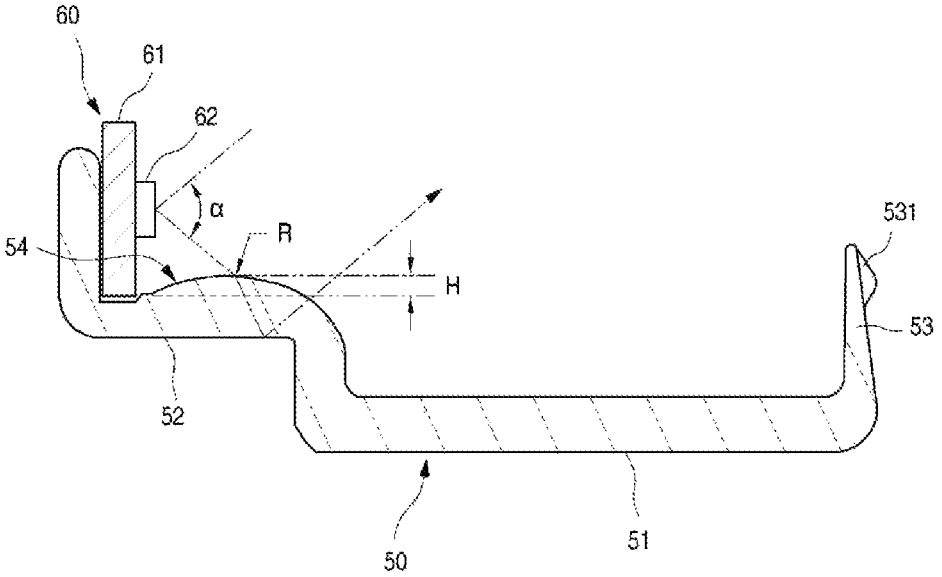
【Figure 12】
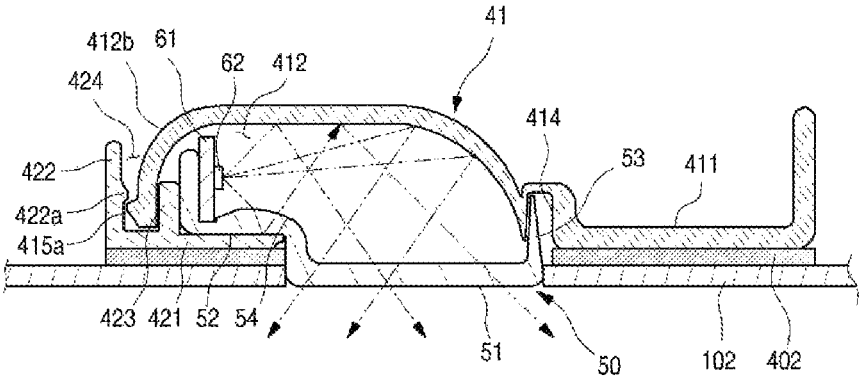

【Figure 13】
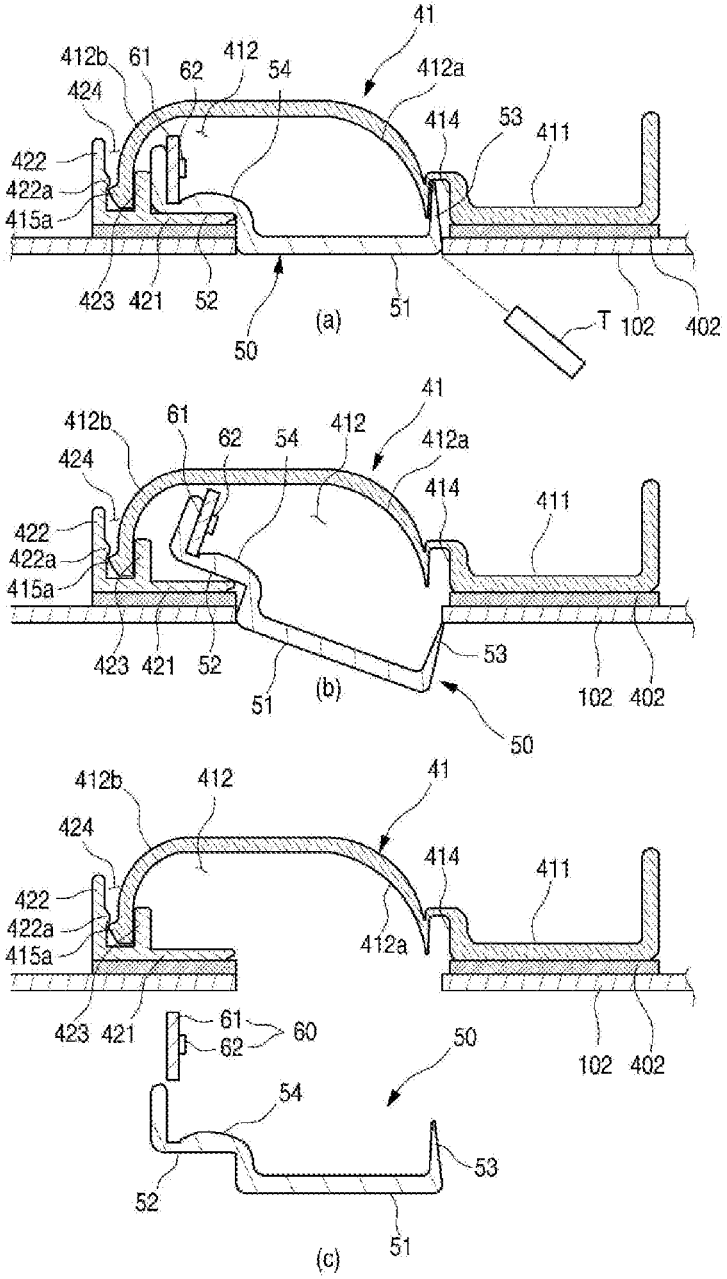

【Figure 14】
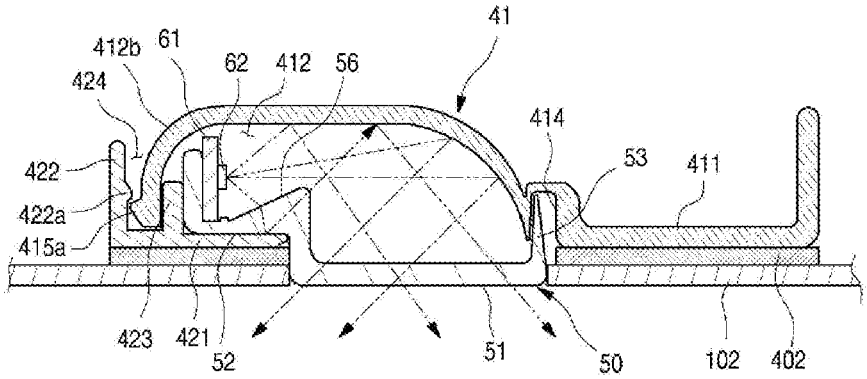
【Figure 15】
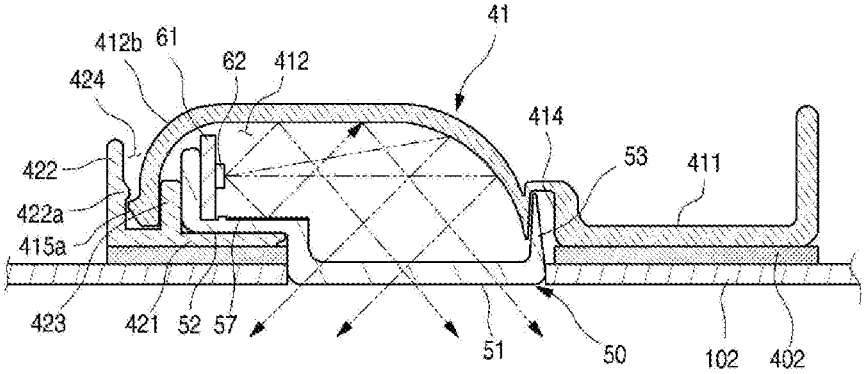

【Figure 16】
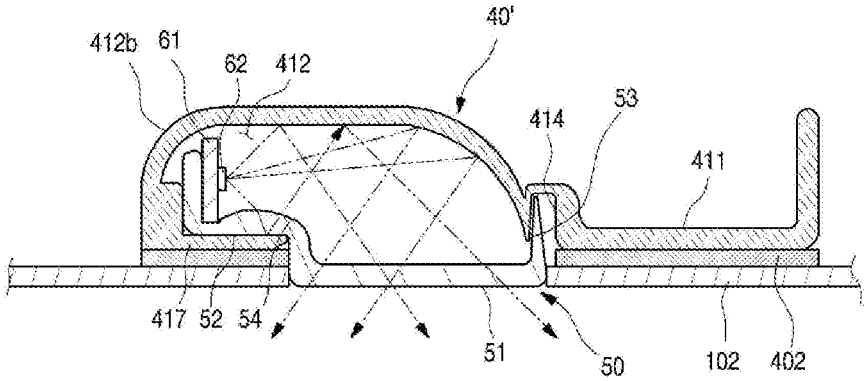

REFRIGERATOR

CROSS-REFERENCE TO RELATED APPLICATIONS

The present application is a continuation of U.S. application Ser. No. 16/035,174, filed on Jul. 13, 2018, which claims priority under 35 U.S.C. 119 and 35 U.S.C. 365 to Korean Patent Application No. 10-2017-0089518, filed on Jul. 14, 2017, which is hereby incorporated by reference in its entirety.

BACKGROUND

The present disclosure relates to a refrigerator.

Generally, a refrigerator is a household appliance that allows low-temperature storage of food in an internal storage space that is shielded by a door. To this end, the refrigerator is configured to store the stored foods in an optimal state by cooling the inside of the storage space using cool air generated via heat exchange with refrigerant circulating in the refrigeration cycle.

Recent refrigerators are becoming increasingly large and multifunctional, depending on changes in diet and high-grade trends. A refrigerator having various structures and convenience devices for the user's convenience and for efficiently using the internal space has been introduced.

The storage space of the refrigerator may be opened or closed by a door. Various types of refrigerators may be classified depending on an arrangement of the storage space and the structure of the door for opening and closing the storage space.

A recent refrigerator has a lighting device capable of illuminating the internal space of the refrigerator as the storage space thereof becomes larger and various foods are stored therein. The lighting device allows the inner space of the refrigerator to be illuminated more brightly so that the user can more conveniently identify and use the contents.

Japanese Laid-Open Patent Application No. 2015-114005 discloses a refrigerator equipped with a lighting module mounted on a wall of an inner space of a refrigerator to illuminate an inner space of the refrigerator.

However, the conventional refrigerator has a structure in which LEDs are provided at both ends. Thus, there is a problem that it is difficult to provide an even and bright light quantity via the entire vertical long lighting module.

Further, a light guide plate is required to realize uniform brightness such as planar light. A component for mounting the light guide plate is further required. As a result, the number of overall components of the refrigerator is relatively increased. Thus, there is a problem that the productivity is lowered, the manufacturing cost is increased, and the service performance is lowered.

In addition, in the entire area of the cover part for blocking the LEDs that forms the appearance of the lighting device, only the area where the light guide plate is disposed emits light. The frame of the light guide plate, in particular, the upper and lower end regions where the light source is disposed, cannot emit light, which is disadvantageous in appearance.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

An embodiment of the present disclosure aims to provide a refrigerator equipped with a lighting device that provides planar light emission and has a simple configuration.

An object of the present disclosure is to provide a refrigerator equipped with a lighting device configured to prevent spotlight and to allow light to emit from the entire face of a cover with uniform brightness.

An embodiment of the present disclosure aims to provide a refrigerator equipped with a lighting device having a light-emitting unit with easy maintenance thereof.

An embodiment of the present disclosure aims to provide a refrigerator that minimizes a connection line generated when the lighting device is installed, thereby improving appearance and preventing contamination.

To this end, in accordance with the present disclosure, there is provided a refrigerator apparatus comprising: a cabinet having an outer case configured to form outer appearance of the refrigerator and an inner case configured to define storage food; an inner case having a refrigerator interior space defined therein; a case opening passing through the inner case; and an lighting device mounted on the case for illuminating planar light through the case opening, wherein the lighting device includes: a lamp case mounted on the inner case and having a cavity defined therein at a position corresponding to the case opening; a light-emitting unit accommodated in the cavity, wherein the light-emitting unit is disposed more outwardly than the case opening, wherein the light-emitting unit irradiates light toward an inner surface of the cavity; a cover coupled with the lamp case to cover the case opening, wherein light from the light-emitting unit is reflected from the cavity through the cover toward the refrigerator interior space; and a reflection portion formed on the cover, wherein the reflection portion is configured to allow light from the light-emission unit directed toward the case opening to be redirected toward the inner surface of the cavity.

In one embodiment, the cover includes: a light-emission portion formed in a shape corresponding to a shape of the case opening, wherein the light-emission portion blocks the case opening and transmits therethrough light reflected from the cavity; and a step portion formed at one end of the light-emission portion and covered by the inner case, wherein the light-emitting unit is oriented to emit light in a direction crossing the step portion.

In one embodiment, the reflection portion protrudes in a round shape from an inner surface of the step portion to refract light emitted from the light-emission unit to be directed to the inner surface of the cavity.

In one embodiment, the reflection portion protrudes in an inclined manner from an inner surface of the step portion to refract light emitted from the light-emission unit to be directed to the inner surface of the cavity.

In one embodiment, the light-emitting unit includes a light-emission member for emitting light, wherein the reflection portion has a height lower than a bottom of the light-emission member.

In one embodiment, the reflection portion includes a planar reflective layer formed an inner surface of the step portion to reflect light emitted from the light-emission unit to be directed to the inner surface of the cavity.

In one embodiment, a reflective surface portion for directing light emitted from the light-emitting unit toward the cover is formed on an inner surface of the cavity, wherein the light-emitting unit faces away the reflective surface portion.

In one embodiment, the light-emitting unit is oriented to irradiate light in a direction opposite to a direction toward an opening of the inner space of the refrigerator.

In one embodiment, the step portion disposed at one end of the cover extends along a back surface of an inner case of the inner case and is constrained by the inner case of the inner case, wherein a rib protruding from the other end of the cover extends rearwardly in contact with the case opening and is inserted into a cover receiving groove defined in the inner case to constrain the rib.

In one embodiment, the inner surface of the cavity has a curvature such that when the rib is disengaged from the cover receiving groove, the step portion is pivotable without interfering with the inner surface of the cavity.

In one embodiment, the lamp case is mounted on an outer surface of the inner case, wherein the cover is insertable through the case opening into the cavity in the inner space of the refrigerator while the light-emitting unit mounted is mounted to the cover.

In one embodiment, one end portion of the cavity defines a cable connection space, wherein the cable connection space is located outside the case opening and is blocked by an inner case of the inner case, wherein the cable connection space receives therein an electric wire passing through the lamp case and connected to the light-emitting unit, and a connector for connecting the electric wire.

In one embodiment, the reflection portion is mounted on the step portion, wherein the light-emitting unit is mounted on the step portion adjacent to the reflection portion, wherein the light emitting unit is mounted on the step portion to be detachable from the step portion via a wire and a connector provided in the lamp case.

In one embodiment, the light-emitting unit includes: a plurality of light-emission members configured for emitting light; and a printed circuit board (PCB) fixedly mounted on the lamp case, wherein the plurality of light-emission members are continuously arranged on the PCB.

In one embodiment, the cover includes: a PCB support bent along an end of the step portion and supporting the PCB; and a PCB fixing portion protruding at a position spaced apart from the PCB support to fix the PCB.

In one embodiment, a fixing-portion receiving groove is defined in an inner surface portion of the cavity to receive an end of the PCB fixing portion.

In one embodiment, the PCB fixing portion includes PCB fixing portions arranged to be spaced apart, wherein a cover support extending from the cover and extending to abut the inner surface of the cavity to support the cover is formed between the PCB fixing portions.

In one embodiment, the PCB support protrudes in a longitudinal direction of the cover beyond the light-emission portion, wherein the connector is disposed on the protruded portion of the PCB support, wherein the protruding end of the PCB support is received inside the cable connection space.

In one embodiment, the lamp case includes: a main case having the cavity defined therein; and an auxiliary case coupled to the main case and covering the step portion.

In one embodiment, the main case and the auxiliary case includes first and second frame portions respectively to define together a circumference of the lamp case, wherein the first and second frame portions have coplanar surfaces adhered to an outer surface of the inner case, wherein the frame of the lamp case surrounds the case opening.

In the refrigerator according to the proposed embodiment, the following effects may be expected. However, effects may not be limited thereto.

According to an embodiment of the present disclosure, the lighting device has the light-emitting unit on one side of the cover. The light emitted from the light-emitting unit may be reflected from the reflective surface of the lamp case, transmitted through the cover, and irradiated externally in a planar light emitting form.

In this connection, the light-emission member is oriented rearward. Thus, when the user views the inner space of the refrigerator from the front, the light-emission member is virtually invisible, thereby preventing the spotlight phenomenon otherwise caused by the light-emission member.

Furthermore, the reflection portion is formed on the stepped portion of the cover on which the light-emission member is mounted. Thus, a portion of the light emitted from the light-emission member is not directly directed to the light-emission portion but is refracted and/or reflected from the reflection portion to be directed to the reflective surface. This prevents the spotlight phenomenon from occurring on the light-emitting portion of the cover.

Therefore, local light concentration through the lighting device does not occur. Thus, light with uniform brightness is provided as a whole. Thereby, there is an advantage that the appearance of the inner space of the refrigerator is excellent and the inner space of the refrigerator is illuminated uniformly.

Further, the light-emitting unit may be mounted together with the cover in the form of a module, so that the mounting of the light-emitting unit is easy, and its replacement or repair is easy.

In particular, with the lighting device being mounted on the cover, the cover may be disengaged from the lamp case and case opening via the pivoting thereof within the interior space of the refrigerator. This is realized by the step portion and the reflection portion of the cover. This has the advantage to simultaneously provide the planar light emission and the easy separation of the cover.

Further, in a state in which the lighting device is mounted, electric wires and connectors connected to the light-emitting unit may be shielded by the inner case in a state where they are accommodated in the cable connection space. Thus, this may provide an easy assembling structure. Further, no additional installation of a cap or frame is required, such that the appearance of the refrigerator is neat.

In addition, since the light-emission portion of the cover is exposed through the case opening without a separate frame or cap, only the connection line between the cover and the inner case is formed, and, there is no need for another connection line, so that the appearance may be further improved.

BRIEF DESCRIPTION OF THE DRAWINGS

FIG. 1 is a view of an open state of a door of a refrigerator according to an embodiment of the present disclosure.

FIG. 2 is a partial perspective view of a structure of an inner case according to an embodiment of the present disclosure.

FIG. 3 is a partially exploded perspective view showing a coupling structure between a lighting device and an inner case according to an embodiment of the present disclosure.

FIG. 4 is a perspective view of the lighting device.

FIG. 5 is a partial perspective view showing a mounting state of the lighting device.

FIG. 6 is an exploded perspective front view of the lighting device.

FIG. 7 is an exploded perspective rear view of the lighting device.

FIG. 8 is a cross-sectional view taken along a line 8-8' of FIG. 2.

FIG. 9 is a perspective view of a combined state between a cover of the lighting device and a light-emitting unit.

FIG. 10 is an exploded perspective view showing a coupling structure between the cover and the light-emitting unit.

FIG. 11 is a cross-sectional view showing the coupling structure between the cover and the light-emitting unit.

FIG. 12 is a view showing an operation state of the lighting device.

FIG. 13 shows a disassembly process of the lighting device in sequence.

FIG. 14 is a cross-sectional view of a lighting device according to another embodiment of the present disclosure.

FIG. 15 is a cross-sectional view of a lighting device according to still another embodiment of the present disclosure.

FIG. 16 is a cross-sectional view of a lighting device according to still yet another embodiment of the present disclosure.

DETAILED DESCRIPTIONS

For simplicity and clarity of illustration, elements in the figures are not necessarily drawn to scale. The same reference numbers in different figures denote the same or similar elements, and as such perform similar functionality. Also, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

FIG. 1 shows an open state of a door of a refrigerator according to the embodiment of the present disclosure.

As shown in the figure, according to an embodiment of the present disclosure, a refrigerator 1 includes a cabinet 10 having a storage space defined therein, and doors 20 and 30 for opening and closing the storage space.

The cabinet 10 may include an outer case 101 forming an outer appearance and an inner case 102 coupled with the outer case 101. The inner case 102 forms the inside of the cabinet 10, i.e., the inner surface of the storage space.

The outer case 101 may be formed of a plate-shape so as to form an outer appearance of the refrigerator 1. Further, in the case of a built-in type refrigerator, a separate furniture panel may be further attached on the outer case. The inner case 102 is made of a plastic material to define the storage space. The inner case 102 may be injection-molded. The inner case may be appropriately shaped according to the internal structure of the storage space. Further, between the outer case 101 and the inner case 102, a heat insulating material (103 in FIG. 8) may be filled. The inside of the storage space may be insulated by the heat insulating material 103 to maintain a low temperature state.

The interior of the cabinet 10 may be partitioned vertically by a barrier 11. A refrigerating chamber 12 may be defined in an upper portion of the cabinet 10 while a freezing chamber 13 may be defined in a lower portion of the cabinet 10.

Inside the refrigerating chamber 12, various accommodation members 121 such as shelves, drawers or baskets may be provided. The accommodation member 121 may be detachable or be adjustable in height in the inner space of the refrigerating chamber. Further, the accommodation member 121 may be retractable and extendable, if necessary, with the refrigerating chamber door 20 opened. Further, a drawer-shaped accommodation member 131 that may be drawn out and pushed into the freezing chamber 13 may be disposed.

The door includes a refrigerating chamber door 20 and a freezing chamber door 30. The refrigerating chamber door 20 opens and closes the opened front surface of the refrigerating chamber 12 via a pivot movement. The freezing chamber door 30 may be configured to open and close the open front of the freezing chamber 13 via a pivot movement. Further, each of the refrigerating chamber door 20 and the freezing chamber door 30 may include a pair of right and left doors so as to shield the freezing chamber 13 and the freezing chamber 13, respectively.

The arrangement of the refrigerating chamber 12 and the freezing chamber 13, the arrangement and opening and closing scheme of the doors 20 and 30 and the like will vary according to the type of the refrigerator 1. It may be appreciated that the present disclosure is applicable to all refrigerator 1, and is not limited to the type of refrigerator 1.

FIG. 2 is a partial perspective view of a structure of the inner case according to an embodiment of the present disclosure. Further, FIG. 3 is a partially exploded perspective view showing a coupling structure between a lighting device and the inner case according to an embodiment of the present disclosure.

As shown in the figure, the inner case 102 may define the inner surface of the storage space. In the inner case 102, the barrier 11 is formed to divide the storage space into the refrigerating chamber 12 and the freezing chamber 13. Grooves or protrusions necessary for mounting the accommodation member 131 may be formed in or on the inner wall of the inner case 102. Further, the inner case 102 may be equipped with a lighting device 400 for illuminating the inside of the storage space.

In the inner wall portion of the inner case 102, a case opening 102*a* for mounting the lighting device 400 therein may be defined. The case opening 102*a* may be defined at a position where the lighting device 400 is mounted. The case opening 102*a* may be defined in left and right side surface portions or top and bottom face portions of the inner case 102. The case opening 102*a* may be oriented toward the inner space of the refrigerator. Therefore, the interior space of the refrigerator may be illuminated by the light emitted from the lighting device 400.

The case opening 102*a* may be defined in a front portion of the inner surface portion of the inner case 102. With the doors 20 and 30 open, the lighting device can brighten the open area of the refrigerating chamber 12 or the freezing chamber 13. Further, the case opening 102*a* is elongated in the vertical direction or the lateral direction. The lighting device disposed in the groove can provide a sufficient amount of light to illuminate the inner space of the refrigerator.

The size of the case opening 102*a* may be smaller than the size of the lighting device 400. The size of the case opening 102*a* is defined to be equal to or smaller than the cover 50 constituting the lighting device 400. In this way, only the cover 50 is exposed in the inner space of the refrigerator, and the rest of the lighting device 400 is screened by the inner case 102.

That is, when the lighting device 400 is mounted on the outer surface of the inner case 102, as shown in FIG. 2, substantial light is transmitted through the case opening 102*a* and only the case opening 102*a* is exposed toward the inner space of the refrigerator. A peripheral portion 401 of a lamp case 40 constituting the frame of the cover 50 may be screened by the inner case 102.

Further, the outer surface of the cover 50 exposed through the case opening 102*a* may have the same plane as the inner case 102. That is, the outer surface of the cover 50 exposed to the inner space of the refrigerator and the inner surface of the inner case 102 may not form a step. This allows the appearance to look neat. Except for a connection line between the cover 50 and the circumference of the case opening 102*a*, remaining portions are not exposed.

FIG. 4 is a perspective view of the lighting device. Further, FIG. 5 is a partial perspective view showing a mounting state of the lighting device.

The lighting device 400 may include a lamp case 40 that defines an overall appearance and a cover 50 that is coupled to the lamp case 40. Further, the lighting device 400 may be mounted in the inner case 102 in an assembled state. Alternatively, while at least the lamp case 40 is mounted in the inner case 102, the cover 50 may be inserted and assembled through the case opening 102*a*.

That is, only the lamp case 40 of the lighting device 400 is first installed in the inner case 102. Subsequently, foam liquid is injected into the cabinet 10 to form the heat insulating material 103. The cover 50 is then assembled to the lamp case 102 to complete the assembly of the lighting device 400.

Therefore, when maintenance is required after mounting the lighting device 400, only the cover 50 may be separated from the inner space of the refrigerator without detaching the entire lighting device 400, thereby facilitating maintenance.

A frame 401, which is in contact with an outer surface of the inner case 102, may be formed around the lamp case 40. An adhesive member 402 such as a double-sided tape or an adhesive may be applied to the peripheral portion 401. Accordingly, the lamp case 40 may be fixedly mounted so that the peripheral portion 401 is in close contact with the inner case 102. In this connection, the case opening 102*a* is located in the inner region of the lamp case 40.

The lamp case 40 may include a main case 41 having a cavity defined therein for accommodating the light-emitting unit 60, and an auxiliary case 42 coupled to the main case 41 to fix and shield one side of the cover 50. The main case 41 and the auxiliary case 42 may be coupled to each other to define the frame 401 and may be in close contact with the outer surface of the inner case 102.

The lamp case 40 is formed of the coupling structure of the main case 41 and the auxiliary case 42, thereby making it possible to easily mold the cavity of the lamp case 40 and the structure for coupling the cover 50.

In one embodiment, when the cover 50 is mounted on the lamp case 40, a portion of the entire cavity of the lamp case 40 is shielded by the cover. The portion that is not shielded by the cover 50 may be defined as a cable connection space 413. The cable connection space 413 is a space in which a connection wire 43 and a connector 431 extending to the inside of the lamp case 40 are connected with a wire 63 and a connector 631 extending from the light-emitting unit 60.

Accordingly, in a state where the lamp case 40 is mounted, the connection cable 43 and the connector 431 are located inside the cable connection space 413. In this state, a foam molding of the heat insulating material 103 is performed. Further, in the process of disposing the light-emitting unit 60 inside the lamp case 40, power to the light-emitting unit 60 may be supplied via the connection between the connectors 431 and 631.

The cable connection space 413 is located more outwardly in the lamp case 40 than the case opening 102*a*. Thus, with the lighting device 400 being mounted on the inner case 102, the cable connection space may be screened by the inner case 102 without being exposed to the outside.

Hereinafter, the structure of the lighting device will be described in more detail with reference to the drawings.

FIG. 6 is an exploded perspective view of the lighting device viewed from the front. Further, FIG. 7 is an exploded perspective view of the lighting device viewed from the rear. Further, FIG. 8 is a cross-section view taken in a line 8-8' of FIG. 2.

As shown in the figure, the lighting device 400 may include a lamp case 40, a cover 50, and a light-emitting unit 60. Further, the lamp case 40 may include a main case 41 and an auxiliary case 42.

More specifically, the main case 41 may be injection-molded using a plastic material. The main case 41 is coupled to the auxiliary case 42 to form the lamp case 40. Further, the main case 41 may include a main frame 411 and a cavity 412 as a whole.

The main frame 411 has a surface contacting the outer surface of the inner case 102. The main frame 411 may have a surface to which the adhesive member 402 such as a double-sided tape is adhered or an adhesive is applied. Further, the main frame 411 extends except for a region where the auxiliary case 42 is coupled to the main case 41. The main frame 411 forms a portion of the frame 401.

The cavity 412 may define a space for accommodating the light-emitting unit 60. The cavity may be defined inside the main frame 411. Further, the inner surface of the cavity 412 may include a reflective surface 412*a* formed to be inclined or rounded. The reflective surface 412*a* is configured to reflect light emitted from the light-emitting unit 60 to pass through the cover 50. Coating, vapor deposition, or the like may be performed on the reflective surface to enhance the reflective effect thereof.

At least one side of the cavity 412 in which the reflective surface 412*a* is defined may be formed to be inclined or rounded so as to be closer to the opening of the cavity 412 as it goes far away from the position where the light-emitting unit 60 is disposed. That is, the light irradiation direction of the light-emitting unit 60 and the reflective surface 412*a* may face each other or cross each other, such that the light emitted from the light-emitting unit 60 may be effectively reflected toward the cover 50.

The reflective surface 412*a* is defined at a position facing one end at which the light-emitting unit 60 is mounted, and is formed to be rounded or inclined. Thus, the light may be guided to a light-emission portion 51 side of the cover 50. The reflective surface 412*a* may be defined on the entire inner surface of the cavity 412.

In addition, a pivoting guide portion 412*b* may be formed at a position on one side of the cavity 412 corresponding to a position where the light-emitting unit 60 is mounted. The pivoting guide portion 412*b* may provide a space by which the cover 50 and the light-emitting unit 60 mounted on the cover 50 may be rotated without interfering with the inner surface of the lamp case 40 when the cover 50 is rotated for separation of the cover 50. For this purpose, the pivoting guide portion 412*b* may be formed in a rounded shape or may have an inclined or stepped shape to avoid interference.

In this way, the inner surface of the cavity 412 may be rounded as a whole. In particular, both ends of the cavity, in which the reflective surface 412*a* and the pivoting guide portion 412*b* are formed, may be rounded.

In one embodiment, the cable connection space 413 may be defined at the upper end of the cavity 412. Further, in the cable connection space 413, a cable hole 413*a* passing through the lamp case 40 may be defined. Accordingly, the connection cable 43 may be introduced into the lamp case 40 through the cable hole 413*a*. The connector 431 may be disposed at an end of the connection cable 43 inside the lamp case 40.

At one end of the cavity 412, a cover receiving groove 414 extending in the up and down direction may be defined. The cover receiving groove 414 may extend along the side of the cavity 412 in contact with the main frame 411. Further, the cover receiving groove 414 is recessed so that the end portion of the cover 50 may be received therein. That is, when the cover 50 is mounted on the lamp case 40, one end of the cover 50 may be inserted into the cover receiving groove 414, so that the end of the cover 50 may be fixed thereto and supported thereon.

A coupling protrusion 415 may be formed on the other side of the cavity 412 opposite the cover receiving groove 414. The coupling protrusion 415 is engaged with the auxiliary case 42. The coupling protrusion may protrude so as to engage with the auxiliary case 42 at one side thereof. The coupling protrusion 415 may protrude to be insertable into a case receiving groove 424 defined in the auxiliary case 42.

Further, on the inside of the cavity 412 adjacent to the coupling protrusion 415, the fixing-portion receiving groove 416 may be defined. The fixing-portion receiving groove 416 may have a corresponding size to and a position corresponding to the PCB fixing portion 552 such that an end of a PCB fixing portion 552 of the cover 50 may be inserted into the fixing-portion receiving groove 416. A plurality of the fixing-portion receiving grooves 416 may be vertically spaced apart.

The auxiliary case 42 is disposed at one end of the main case 41 and is coupled to the main case 41 to form the lamp case 40. The auxiliary case 42 may include a blocking portion 421 in contact with the inner case 102, and an outer extension 422 and an inner extension 423 extending from the back surface of the blocking portion 421.

When the main case 41 and the auxiliary case 42 are coupled to each other, the blocking portion 421 is located on the same plane as the main frame 411 and thus defines together the frame 401. Thus, the blocking portion 421 along with the main frame 411 defines a portion of the frame 401, and may thus be referred to as an auxiliary frame. Further, the adhesive member 402 or the adhesive is applied on the blocking portion 421, Thereby, via the blocking portion 421, the inner case 102 may be attached to the lamp case 40.

In one embodiment, the blocking portion 421 extends to abut the top surface of the cover 50. The blocking portion 421 may shield one side of the cover 50 and at the same time maintain the cover 50 in a fixed state. In this connection, the blocking portion 421 contacts the step portion 52 formed on the top surface of the cover 50 such that the blocking portion 421 may shield the light-emitting unit 60 to prevent the unit 60 from being exposed to the outside.

Further, the blocking portion 421 may have a length such that the light from the light-emission member 62 is prevented from being concentrated onto the light-emission portion 51, thereby preventing the spotlight, while a sufficient amount of light may be ensured.

Specifically, a length L of the blocking portion 421 from the inner extension 423 to a distal end of the portion 421 may be approximately 8 to 10 mm. If the length of the blocking portion 421 is smaller than 8 mm, the step portion 52 of the cover may not be stably fixed and a portion of the light emitted from the light-emission member 62 is directly directed to the light-emission portion 51 such that a spotlight may be generated on the light-emission portion 51. Therefore, the length of the blocking portion 421 is preferably 8 mm or larger such that planar light emission from the light-emission portion 51 may be realized without the spotlight occurring on the light-emission portion 51. Further, when the length of the blocking portion 421 exceeds 10 mm, the length of the blocking portion 421 becomes excessively long, which makes it difficult to separate and assemble the cover 50, and, further, the area of the light-emission portion 51 may be narrowed. When the light-emission portion 51 is narrowed, the planar light emission area is narrowed. As a result, the total amount of light is reduced, and, hence, the internal space of the refrigerator cannot be sufficiently illuminated. Further, when the blocking portion 421 becomes too long, the light emitted from the light-emission member 62 may be excessively shielded, so that the light-emission portion 51 may not have sufficient brightness.

The outer extension 422 and inner extension 423 extending rearward from the back surface of the blocking portion 421 may be formed. Each of the outer extension 422 and the inner extension 423 may extend from the upper end of the auxiliary case 42 to the lower end thereof. Further, the outer extension 422 may be formed at the outer end of the auxiliary case 42, while the inner extension 423 may be spaced apart from the outer extension 422. Further, in the spacing between the inner extension 423 and the outer extension 422, the case receiving groove 424 into which the coupling protrusion 415 is inserted may be defined.

In one embodiment, the outer extension 422 has a first stopper protrusion 422*a* projecting inward of the case receiving groove 424. The first stopper protrusion 422*a* is engaged with a second stopper protrusion 415*a* protruded from the coupling protrusion 415 of the main case 41. To this end, the first stopper protrusion 422*a* and the second stopper protrusion 415*a* may be formed in a hook shape or a shape corresponding to each other.

When the auxiliary case 42 is mounted on the main case 41, the coupling protrusion 415 of the main case 41 is inserted into the case receiving groove 424. At the same time, the first stopper protrusion 422*a* and the second stopper protrusion 415*a* are coupled to each other, so that the main case 41 and the auxiliary case 42 may be firmly coupled and fixed to each other.

The cover 50 may be mounted to the lamp case 40 such that the cover 50 may direct light emitted from the light-emitting unit 60 toward the inner space of the refrigerator. Further, the cover 50 may be combined with the light-emitting unit 60 that emits light. The light-emitting unit 60 may be disposed at a position facing the reflective surface 412*a* of the cavity 412 such that the unit 60 may irradiate light toward the reflective surface 412*a*. Accordingly, the light passing through the cover 50 comes from light reflected from the reflective surface 412*a*, whereby the lighting device 400 may realize planar light emission.

The cover 50 and the light-emitting unit 60 may be coupled to each other. A combination of the cover 50 and the light-emitting unit 60 may be mounted on the lamp case 40.

Hereinafter, the structures of the cover 50 and the light-emitting unit 60 will be described in detail with reference to the drawings.

FIG. 9 is a perspective view of a combined state of the cover of the lighting device and the light-emitting unit thereof. Further, FIG. 10 is an exploded perspective view showing a coupling structure between the cover and the light-emitting unit.

As shown in the figure, the cover 50 may be made of a plastic material capable of transmitting light. The cover 50 may be mounted to shield a portion of the cavity 412 defined in the lamp case 40. Further, the light-emitting unit 60 may be fixedly mounted on the cover 50. The unit 60 may include a plurality of light-emission members 62 and a PCB 61 on which the light-emission members 62 are mounted.

The cover 50 may include the light-emission portion 51 formed in a shape corresponding to the case opening 102*a* and exposed toward the inner space of the refrigerator, and a step portion 52 formed to be stepped at one end of the light-emitting portion 51 and to which the light-emitting unit 60 is mounted. In this way, the cover 50 may have a shape of a front surface exposed to the outside. Further, the cover may include a rib 53 extending vertically along the periphery of the light-emitting portion 51.

The light emitted from the light-emitting unit 60 is reflected from the reflective surface 412*a*, and then the reflected light is transmitted through the light-emission portion 51 to be directed to the inner space of the refrigerator. The light-emission portion 51 may be formed to have substantially the same size as the case opening 102*a*. The light-emitting portion 51 may be exposed toward the inner space of the refrigerator through the case opening 102*a*.

In one embodiment, the back surface of the light-emission portion 51 may be subjected to a fine surface treatment such that the portion 51 may be capable of diffusing light to realize planar light emission. If necessary, the back surface of the light-emission portion 51 may be subjected to a coating or painting treatment such that the portion 51 may be capable of having a planar light emission effect.

Further, the rib 53 may be formed around the light-emission portion 51 except for the portion of the portion 51 as connected to the step portion 52. The rib 53 extends vertically from the light-emission portion 51 at a predetermined length. The ribs 53 may be received inside the cavity 412 of the lamp case 40. Particularly, one end of the rib 53 corresponding to the cover receiving groove 414 may be inserted into the cover receiving groove 414 to achieve a fixed state of the cover 50. Further, a fixing protrusion 531 may be formed on the rib 53 for more rigid coupling of the cover 50. The fixing protrusion 531 may be engaged with the main case 41 on the inside of the cover receiving groove 414.

The step portion 52 may be stepped at one end of the light-emission portion 51. On the step portion 52, a blocking portion 421 of the auxiliary case 42 may be seated. In a state in which the blocking portion 421 is seated on the step portion 52, the blocking portion 421 is capable of blocking the light-emitting unit 60 mounted on the cover 50.

To this end, the auxiliary case 42 may be coupled to the main case 41 in a state where the cover 50 is assembled to the main case 41. Via the coupling between the auxiliary case 42 and the main case 41, the blocking portion 421 of the auxiliary case 42 is seated on the step portion 52 to shield the entire step portion 52. The light-emitting unit 60 located on the back surface of the step portion 52 may be shielded from being exposed to the outside by the blocking portion 421.

A PCB support 55 may protrude from the end of the step portion 52. The PCB support 55 may extend vertically from the end of the step portion 52 and may support the backside of the light-emitting unit 60.

The PCB support 55 may have a length and a width corresponding to the length and width of the light-emitting unit 60. Further, the upper end of the PCB support 55 may protrude beyond the rib 53 of the cover 50, and may extend to the cable connection space 413. Further, the PCB support 55 protruding toward the outside of the cover 50 may have a hole 554 defined therein through which the electric wire 63 enters and exits.

Further, a plurality of cut-outs 551 may be defined in the PCB support 55. A plurality of PCB fixing portions 552 may be formed adjacent the cut-outs 551 respectively. The PCB fixing portion 552 may be spaced from the PCB support 55 by a distance corresponding to the thickness of the PCB 61. Accordingly, the PCB 61 may be fixedly mounted between the PCB fixing portion 552 and the PCB support 55.

Preferably, the PCB fixing portion 552 is positioned between the plurality of light-emission members 62 so that the PCB fixing portion 552 does not interfere with the light-emission member 62 mounted on the PCB 61. Further, an end of the PCB fixing portion 552 may be formed in a hook shape to constrain the side edge of the PCB 61.

A cover support 553 may be formed between the plurality of PCB fixing portions 552. The cover support 553 may protrude from the back surface of the step portion 52 and extend to the inner surface of the main case 41. Therefore, when the cover 50 is mounted on the main case 41, a portion thereof corresponding to the step portion 52 may be supported so that the cover 50 is not damaged or the mounting position thereof is not changed even when a load is applied to the cover 50.

Further, the cover support 553 is formed adjacent to the PCB fixing portion 552. Therefore, even when the user presses the cover 50, the gap between the cover and the main case 41 is maintained by the cover support 553 such that the PCB 61 is prevented from being damaged. Further, the extended end of the cover support 553 may be rounded so that the load exerted through the cover support 553 may be distributed.

In one embodiment, a reflection portion 54 may be formed to protrude between the PCB fixing portion 552 and the end of the step portion 52. The reflection portion 54 prevents a portion of the light emitted from the light-emission member 62 from being directly irradiated toward the cover 50. As a result, it is possible to prevent spotlight phenomenon from occurring on the cover 50. Therefore, the reflection portion could be called "spotlight-prevention portion" or "the spotlight-suppressing portion". To this end, the reflection portion 54 may be formed so that the amount of light may be secured by directing the refracted and/or reflected light toward the light-emission portion 51.

The reflection portion 54 may be formed along the longitudinal direction of the cover 50 and may extend from the upper end of the cover 50 to the lower end of the cover 50. Further, the reflection portion 54 may be formed over the stepped edge area of the step portion 52 and may protrude toward the inner surface of the main case 41. The structure of the reflection portion 54 will be described in more detail below.

The light-emitting unit 60 may include a PCB 61 mountable on the cover 50 and a plurality of light-emission members 62 mounted on the PCB 61. The light-emission member 62 may be the LED. The present invention is not limited to this. The light-emission member 62 may have another configuration capable of irradiating light, if necessary.

The PCB 61 may extend a length corresponding to the length of the cover support 553. The extended top of the PCB 61 may protrude to the top of the cover 50. Further, the PCB 61 may have a wire connecting portion 611 formed thereon. The wire connection portion 611 may be located in the cable connection space 413.

The PCB 61 is supported by the cover support 553. The PCB 61 may be constrained by the PCB fixing portion 552 and fixedly mounted on the cover 50. In this connection, the PCB 61 may be oriented perpendicular to the cover 50, the inner case 102, or the main frame 411 of the main case 41.

Accordingly, the light-emission member 62 mounted on the PCB 61 is turned on to irradiate light. The light is irradiated in a direction parallel to the cover 50, the inner case 102, or the main frame 411 of the main case 41. Further, the light emitted from the light-emission member 62 is reflected by the reflective surface 412*a* of the cavity 412 and then is directed toward the cover 50.

The lighting device 400 may be mounted such that the step portion 52 where the PCB is disposed faces forwardly and the light-emitting portion 51 is located behind the step portion 52. Therefore, when the user looks at the inner space of the refrigerator with the inner space of the refrigerator being open, the light-emission member 62 mounted on the PCB 61 may be prevented from being exposed toward the user.

Further, the reflection portion may be disposed within an irradiation angle range of light irradiated from the light-emission member 62. That is, even when the light-emitting unit 60 is disposed at a position adjacent to the light-emission portion 51, the light emitted from the light-emission member 62 may be refracted by the reflection portion 54 and hence be prevented from being directly irradiated onto the cover 50.

FIG. 11 is a cross-sectional view showing the combined structure of the cover and the light-emitting unit.

As shown in the figure, the light-emitting unit 60 is disposed on the step portion 52 and is mounted such that a back side thereof is supported by the PCB support 55. In this connection, the PCB 61 is oriented in a direction perpendicular to the step portion or the light-emission portion 51. The light-emission member 62 may be oriented so as to be perpendicular to the side surface of the inner space of the refrigerator.

In this connection, the reflection portion 54 may be positioned within a range of the light irradiation angle $\alpha$ of light from the light-emission member 62. The reflection portion 54 may be formed to protrude from the back surface of the step portion 52, and may be rounded to have a predetermined curvature. Further, the reflection portion 54 may be protruded by a predetermined height. For example, the reflection portion 54 may have a radius of curvature R 7.2 mm, and a projection height H 0.9 mm.

Accordingly, the reflection portion 54 may be curved so as to round from the one end of the step portion 52 adjacent to the PCB 61 to the other end of the step portion 52 adjacent to the cavity 412. In this connection, the projected curvature of the reflection portion 54 causes the light emitted from the light-emission member 62 to be refracted, thereby preventing the light from immediately directing to the light-emission portion 51.

In detail, the light in the lower end region of the irradiation range of the light irradiated from the light-emission member 62 is directed to the reflection portion 54. In this connection, the light incident on the reflection portion 54 may be refracted by the curvature of the outer surface of the reflection portion 54. Thus, the light to be irradiated thereto may be refracted so as to face toward the step portion 52 without being immediately directed to the light-emission portion 51. Further, the step portion 52 prevents light from passing through a portion shielded by the auxiliary case 42 or the inner case 102, but rather, allows the light to be reflected.

Therefore, a portion of the light emitted from the light-emission member 62 may be prevented from directing toward the light-emission portion 51. Thus, light is prevented from being spotted in a region corresponding to the light-emission member 62 on the cover 50.

Even when the light-emitting unit 60 is not disposed too far from the light-emission portion 51, the spotlight phenomenon does not appear on the light-emission portion 51 due to the refraction of light by the reflection portion 54. Thus, planar light emission effect is realized, while a sufficient illuminance to illuminate the inner space of the refrigerator is secured.

Hereinafter, an operation of the lighting device having the above structure will be described with reference to the drawings.

FIG. 12 is a view showing an operation state of the lighting device.

As shown, when the refrigerating chamber door 20 or the freezing chamber door 30 is opened or a turn-on command of the lighting device 400 is inputted by the user, the lighting device 400 is turned on and irradiate light into the interior space of the refrigerator to illuminate the interior space of the refrigerator. In this connection, light is irradiated through the cover 50 exposed to the inner surface of the inner case 102 toward the inner space of the refrigerator. Thus, the light-emission portion 51 of the cover 50 realizes a planar light emission/As a result, not only the inner space of the refrigerator may be illuminated evenly, but also the appearance of the refrigerator may feel more comfortable and bright by the user.

In detail, the light-emission member 62 is turned on according to the operation signal of the lighting device 400. Most of the light emitted from the light-emission member 62 is directed to the reflective surface 412*a* on the inner side of the cavity 412. Light reflected by the reflective surface 412*a* passes through the light-emission portion 51 of the cover. In this process, the light directed to the light-emission portion 51 is reflected light, which enables the same effect as indirect illumination. Further, the light passing through the light-emission portion 51 is diffused to be visible as a planar light emission to the outside.

A portion of the light emitted from the light-emission member 62 is directed toward the step portion 52. In this connection, if the reflection portion 54 is not formed and the step portion 52 is formed in a planar shape, the irradiated light may pass through the step portion 52 and may be directed to the light-emission portion 51. Accordingly, a spotlight may be generated on the light-emission portion 51. However, according to the present invention, as shown in FIG. 12, the reflection portion 54 is formed on the step portion 52. As a result, light directed to the step portion 52 passes through the reflection portion 54. Then, the light incident on the reflection portion 54 is refracted by the curvature of the reflection portion 54. Thereby, the light is directed to the front direction of the step portion 52 without being directed to the light-emission portion 51. The front of the step portion 52 is shielded by the auxiliary case 42 or the inner case 102. As a result, the light directed toward the front of the step portion 52 is reflected on the reflective surface 412*a* and is irradiated to the inner space of the refrigerator through the cover 50.

Therefore, all of the light emitted from the light-emission member 62 is the light reflected from the reflective surface 412*a*, and, then, the reflected light passes through the cover. Thus, when viewed from the inner space of the refrigerator, the illumination from the cover 50 realizes the same effect as the indirect illumination and causes the surface light emission. Further, it is possible to prevent local spotlight phenomenon, in particular, occurrence of a spotlight phenomenon on a position corresponding to the light-emission member 62.

In one embodiment, the lighting device has a structure that may be separated from the mounted state for maintenance. Hereinafter, the disassembling process of the lighting device will be described with reference to the drawings.

FIG. 13 shows the disassembly process of the lighting device in sequence.

The lighting device 400 maintains the mounted state as shown in FIG. 5. When the lighting device 400 is mounted on the inner case 102, only the cover 50 is exposed toward the inner space of the refrigerator.

In this connection, the outer surface of the light-emission portion 51 of the cover 50 and the inner surface of the inner case 102 have the same plane. That is, while, in the mounted state of the lighting device 400, the light-emission portion 51 of the cover 50 is inserted into the case opening 102*a*, the light-emission portion 51 of the cover 50 only shields the case opening 102*a* and does not protrude toward the inner space of the refrigerator. Thus, the wall surface of the inner space of the refrigerator in which the lighting device 400 is mounted may have a smooth surface without steps thereon.

There is no other connection line except for the boundary line between the light-emission portion 51 and the case opening 102*a*, thereby allowing the appearance to be very clean and to prevent foreign matters from being introduced thereto. Further, without additional caps, the wires 43 and 63 and connectors 431 and 631, which are connected to the light-emitting unit 60, are located inside the cable connection space 413, which are shielded by the inner case 102. This allows the appearance to be kept cleaner while maintaining the convenience of assembly and service.

In one embodiment, during use of the lighting device 400 with the mounted state, a situation may arise where an abnormality of the light-emitting unit 60 necessitates replacement or repair of the light-emitting unit 60. For this or other reasons, situations may arise where disassembly of the lighting device 400 is required.

To this end, the user first separates the cover 50 from the case opening 102*a* and the lamp case 40 using a tool T, such as a screwdriver or a thin plate, in the interior space of the refrigerator, as in FIG. 13*a*.

When the tool T is inserted into the space between the rib 53 of the cover 50 and the inner case 102 and the tool is lifted up, as in FIG. 13*b*, the rib 53 is separated from the cover receiving groove 414 and is pivoted about the step portion 52.

Since the step portion 52 covers the auxiliary case 42 or the inner case 102 and does not have a separate coupling structure, the cover 50 may be disengaged only by the separation of the ribs 53.

Further, the step portion 52 may also have a width that is not excessively large and which allows escaping of the step portion from the cavity 412 of the lamp case 40 by simple pivoting. Further, the cavity 412 has a rounded shape. As a result, no interference occurs during pivoting of the step portion 52. As shown in FIG. 13*c*, after the cover 50 is pivoted from the lamp case 40, the cover may exit through the case opening 102*a*.

In this connection, the above defined width of the step portion 52 and the rounded shape of the cavity 412 may realize easy separation of the cover 50, effective reflection of the light emitted from the light-emitting unit 60, and spot-light suppression.

That is, if the width of the step portion 52 is excessively wide, it is possible to prevent spotlight by blocking light directly directed to the light-emission portion 51. However, when the cover 50 is pivoted, the step portion may interfere with the inner surface of the cavity 412, so that the cover may not be easily separated.

However, if the width of the step portion 52 is short, the light of the light-emission member 62 may be directly directed to the light-emission portion 51, resulting in a spot-light phenomenon. Therefore, in accordance with the present disclosure, the light from the light-emission member 62 is refracted by the reflection portion 54 formed on the step portion 52 to prevent the spotlight phenomenon.

That is, the step portion 52 may have a width such that separating the cover 50 is achieved via pivoting. At the same time, the reflection portion 54 refracts light toward the light-emission portion 51 and thus the light is directed to the reflective surface 412*a*, thereby preventing spotlight while securing a sufficient amount of light.

Further, the inner surface of the cavity 412 has a curvature that facilitates the detachment of the cover 50. At the same time, the inner surface of the cavity 412 has a curvature that allows the light emitted by the light-emission member 62 to be directed to the cover 50. In one embodiment, when the cover 50 is completely separated from the lamp case 40, the light-emitting unit 60 may be detached together with the cover 50 while being coupled with the cover 50.

Furthermore, the cover 50 may be completely separated from the lighting device 400 by separating the wires 43 and 63 connected to the light-emitting unit 60 and the connectors 431 and 631 provided on the wires 43 and 63. In this state, the light-emitting unit 60 may be separated from the cover 50, Then, a repair or replacement operation of the light-emitting unit 60 is performed. Thereafter, the light-emitting unit 60 may be reattached to the cover 50. Then, after the connectors 431 and 631 are connected again to the unit 60, the cover 50 may be mounted in the reverse order to the above-described procedure.

In this way, when replacement or repair of the lighting device 400 is required, there is no need to separate or mount the entire lighting device 400. The cover 50 may be easily separated from the inner space of the refrigerator in a state where the lamp case 40 is fixedly mounted. Then, the unit 60 may be repaired or replaced.

The present disclosure may include various other embodiments as well as the foregoing embodiments. In another embodiment of the present disclosure, a reflection portion protruding on the back surface of the step portion is formed in an inclined shape. Another embodiment of the present disclosure is the same as those as described above except for a configuration of the reflection portion. Thus, overlapping descriptions of the same components will be omitted. The same components will be described using the same reference numerals.

FIG. 14 is a cross-sectional view of a lighting device according to another embodiment of the present disclosure.

As shown in the figure, according to another embodiment of the present disclosure, a lighting device 400 is mounted within the inner case 102. The cover 50 is exposed through the case opening 102*a* so that the light passing through the cover 50 illuminates the inner space of the refrigerator. The lighting device 400 includes a lamp case 40 including the main case 41 and an auxiliary case 42, and a cover 50 coupled to the lamp case 40. The light-emitting unit 60 may be mounted on the cover 50.

In the main case 41, a cavity 412 is formed in which the light-emitting unit 60 is received. On the inner surface of the cavity 412, a reflective surface 412*a* may be formed. The light-emission member 62 may be positioned in a direction facing away or opposite to the reflective surface 412*a*. Therefore, the light emitted from the light-emission member 62 is reflected by the reflective surface 412*a* and then directed toward the cover 50.

The auxiliary case 42 is disposed at one end of the main case 41 and is coupled to the main case 41 to form the lamp case 40. The auxiliary case 42 may include a blocking portion 421 in contact with the inner case 102, and an outer extension 422 and an inner extension 423 extending from the back surface of the blocking portion 421.

When the main case 41 and the auxiliary case 42 are coupled to each other, the blocking portion 421 is located on the same plane as the main frame 411 and thus defines together the frame 401. Thus, the blocking portion 421 along with the main frame 411 defines a portion of the frame 401, and may thus be referred to as an auxiliary frame. Further, the adhesive member 402 or the adhesive is applied on the blocking portion 421, Thereby, via the blocking portion 421, the inner case 102 may be attached to the lamp case 40.

In one embodiment, the blocking portion 421 extends to abut the top surface of the cover 50. The blocking portion 421 may shield one side of the cover 50 and at the same time maintain the cover 50 in a fixed state. In this connection, the blocking portion 421 contacts the step portion 52 formed on the top surface of the cover 50 such that the blocking portion 421 may shield the light-emitting unit 60 to prevent the unit 60 from being exposed to the outside.

Further, the blocking portion 421 may have a length such that the light from the light-emission member 62 is prevented from being concentrated onto the light-emission portion 51, thereby preventing the spotlight, while a sufficient amount of light may be ensured.

Specifically, a length L of the blocking portion 421 from the inner extension 423 to a distal end of the portion 421 may be approximately 8 to 10 mm. The outer extension 422 and inner extension 423 extending rearward from the back surface of the blocking portion 421 may be formed. Each of the outer extension 422 and the inner extension 423 may extend from the upper end of the auxiliary case 42 to the lower end thereof. Further, the outer extension 422 may be formed at the outer end of the auxiliary case 42, while the inner extension 423 may be spaced apart from the outer extension 422. Further, in the spacing between the inner extension 423 and the outer extension 422, the case receiving groove 424 into which the coupling protrusion 415 is inserted may be defined.

In one embodiment, the outer extension 422 has a first stopper protrusion 422*a* projecting inward of the case receiving groove 424. The first stopper protrusion 422*a* is engaged with a second stopper protrusion 415*a* protruded from the coupling protrusion 415 of the main case 41. To this end, the first stopper protrusion 422*a* and the second stopper protrusion 415*a* may be formed in a hook shape or a shape corresponding to each other.

When the auxiliary case 42 is mounted on the main case 41, the coupling protrusion 415 of the main case 41 is inserted into the case receiving groove 424. At the same time, the first stopper protrusion 422*a* and the second stopper protrusion 415*a* are coupled to each other, so that the main case 41 and the auxiliary case 42 may be firmly coupled and fixed to each other.

The cover 50 may be mounted to the lamp case 40 such that the cover 50 may direct light emitted from the light-emitting unit 60 toward the inner space of the refrigerator. Further, the cover 50 may be combined with the light-emitting unit 60 that emits light. The light-emitting unit 60 may be disposed at a position facing the reflective surface 412*a* of the cavity 412 such that the unit 60 may irradiate light toward the reflective surface 412*a*. Accordingly, the light passing through the cover 50 comes from light reflected from the reflective surface 412*a*, whereby the lighting device 400 may realize planar light emission.

The cover 50 and the light-emitting unit 60 may be coupled to each other. A combination of the cover 50 and the light-emitting unit 60 may be mounted on the lamp case 40. As shown in the figure, the cover 50 may be made of a plastic material capable of transmitting light. The cover 50 may be mounted to shield a portion of the cavity 412 defined in the lamp case 40. Further, the light-emitting unit 60 may be fixedly mounted on the cover 50. The unit 60 may include a plurality of light-emission members 62 and a PCB 61 on which the light-emission members 62 are mounted.

The cover 50 may include the light-emission portion 51 formed in a shape corresponding to the case opening 102*a* and exposed toward the inner space of the refrigerator, and a step portion 52 formed to be stepped at one end of the light-emitting portion 51 and to which the light-emitting unit 60 is mounted. In this way, the cover 50 may have a shape of a front surface exposed to the outside. Further, the cover may include a rib 53 extending vertically along the periphery of the light-emitting portion 51.

The light emitted from the light-emitting unit 60 is reflected from the reflective surface 412*a*, and then the reflected light is transmitted through the light-emission portion 51 to be directed to the inner space of the refrigerator. The light-emission portion 51 may be formed to have substantially the same size as the case opening 102*a*. The light-emitting portion 51 may be exposed toward the inner space of the refrigerator through the case opening 102*a*.

In one embodiment, the back surface of the light-emission portion 51 may be subjected to a fine surface treatment such that the portion 51 may be capable of diffusing light to realize planar light emission. If necessary, the back surface of the light-emission portion 51 may be subjected to a coating or painting treatment such that the portion 51 may be capable of having a planar light emission effect.

Further, the rib 53 may be formed around the light-emission portion 51 except for the portion of the portion 51 as connected to the step portion 52. The rib 53 extends vertically from the light-emission portion 51 at a predetermined length. The ribs 53 may be received inside the cavity 412 of the lamp case 40. Particularly, one end of the rib 53 corresponding to the cover receiving groove 414 may be inserted into the cover receiving groove 414 to achieve a fixed state of the cover 50. Further, a fixing protrusion 531 may be formed on the rib 53 for more rigid coupling of the cover 50. The fixing protrusion 531 may be engaged with the main case 41 on the inside of the cover receiving groove 414.

The step portion 52 may be stepped at one end of the light-emission portion 51. On the step portion 52, a blocking portion 421 of the auxiliary case 42 may be seated. In a state in which the blocking portion 421 is seated on the step portion 52, the blocking portion 421 is capable of blocking the light-emitting unit 60 mounted on the cover 50.

To this end, the auxiliary case 42 may be coupled to the main case 41 in a state where the cover 50 is assembled to the main case 41. Via the coupling between the auxiliary case 42 and the main case 41, the blocking portion 421 of the auxiliary case 42 is seated on the step portion 52 to shield the entire step portion 52. The light-emitting unit 60 located on the back surface of the step portion 52 may be shielded from being exposed to the outside by the blocking portion 421.

In one embodiment, a reflection portion 56 may be formed to protrude between the PCB fixing portion 552 and the end of the step portion 52. The reflection portion 56 prevents a portion of the light emitted from the light-emission member 62 from being directly irradiated toward the cover 50. As a result, it is possible to prevent spotlight phenomenon from occurring on the cover 50. To this end, the reflection portion 56 may be formed so that the amount of light may be secured by directing the refracted and/or reflected light toward the light-emission portion 51.

The reflection portion 56 may be formed to have an inclined surface that gradually protrudes upwardly as the distance thereof from the light-emitting unit 60 increases. In this connection, the protrusion height of the reflection portion 56 may be formed to be lower than that of the end portion of the light-emission member 62 so as not to block the light-emission member 62. The reflection portion 56 may extend from a position adjacent to the light-emitting unit 60 to the end of the step portion 52.

Most of the light emitted from the light-emission member 62 is reflected by the reflective surface 412*a* and then is directed toward the cover 50. Further, a portion of the light emitted from the light-emission member 62 is directed to an inclined surface of the reflection portion 56. Further, light directed to the reflection portion 56 may be incident on and refracted from the outer surface of the reflection portion 56. Then, the refracted light is directed toward the front of the step portion 52 without being directed to the light-emission portion 51. The front of the step portion 52 is shielded by the auxiliary case 42 or the inner case 102. As a result, the light directed toward the front of the step portion 52 is reflected on the reflective surface 412*a* and is irradiated to the inner space of the refrigerator through the cover 50.

Therefore, all of the light emitted from the light-emission member 62 is the light reflected from the reflective surface 412*a*, and, then, the reflected light passes through the cover. Thus, when viewed from the inner space of the refrigerator, the illumination from the cover 50 realizes the same effect as the indirect illumination and causes the surface light emission. Further, it is possible to prevent local spotlight phenomenon, in particular, occurrence of a spotlight phenomenon on a position corresponding to the light-emission member 62.

The present disclosure may include various other embodiments as well as the foregoing embodiments. In another embodiment of the present disclosure, a reflection portion formed on the back surface of the step portion is configured to reflect light. Another embodiment of the present disclosure is the same as those as described above except for a configuration of the reflection portion. Thus, overlapping descriptions of the same components will be omitted. The same components will be described using the same reference numerals.

FIG. 15 is a cross-sectional view of a lighting device according to still another embodiment of the present disclosure.

As shown in the figure, according to another embodiment of the present disclosure, a lighting device 400 is mounted within the inner case 102. The cover 50 is exposed through the case opening 102*a* so that the light passing through the cover 50 illuminates the inner space of the refrigerator. The lighting device 400 includes a lamp case 40 including the main case 41 and an auxiliary case 42, and a cover 50 coupled to the lamp case 40. The light-emitting unit 60 may be mounted on the cover 50.

In the main case 41, a cavity 412 is formed in which the light-emitting unit 60 is received. On the inner surface of the cavity 412, a reflective surface 412*a* may be formed. The light-emission member 62 may be positioned in a direction facing away or opposite to the reflective surface 412*a*. Therefore, the light emitted from the light-emission member 62 is reflected by the reflective surface 412*a* and then directed toward the cover 50.

The auxiliary case 42 is disposed at one end of the main case 41 and is coupled to the main case 41 to form the lamp case 40. The auxiliary case 42 may include a blocking portion 421 in contact with the inner case 102, and an outer extension 422 and an inner extension 423 extending from the back surface of the blocking portion 421.

When the main case 41 and the auxiliary case 42 are coupled to each other, the blocking portion 421 is located on the same plane as the main frame 411 and thus defines together the frame 401. Thus, the blocking portion 421 along with the main frame 411 defines a portion of the frame 401, and may thus be referred to as an auxiliary frame. Further, the adhesive member 402 or the adhesive is applied on the blocking portion 421, Thereby, via the blocking portion 421, the inner case 102 may be attached to the lamp case 40.

In one embodiment, the blocking portion 421 extends to abut the top surface of the cover 50. The blocking portion 421 may shield one side of the cover 50 and at the same time maintain the cover 50 in a fixed state. In this connection, the blocking portion 421 contacts the step portion 52 formed on the top surface of the cover 50 such that the blocking portion 421 may shield the light-emitting unit 60 to prevent the unit 60 from being exposed to the outside.

Further, the blocking portion 421 may have a length such that the light from the light-emission member 62 is prevented from being concentrated onto the light-emission portion 51, thereby preventing the spotlight, while a sufficient amount of light may be ensured.

Specifically, a length L of the blocking portion 421 from the inner extension 423 to a distal end of the portion 421 may be approximately 8 to 10 mm. The outer extension 422 and inner extension 423 extending rearward from the back surface of the blocking portion 421 may be formed. Each of the outer extension 422 and the inner extension 423 may extend from the upper end of the auxiliary case 42 to the lower end thereof. Further, the outer extension 422 may be formed at the outer end of the auxiliary case 42, while the inner extension 423 may be spaced apart from the outer extension 422. Further, in the spacing between the inner extension 423 and the outer extension 422, the case receiving groove 424 into which the coupling protrusion 415 is inserted may be defined.

In one embodiment, the outer extension 422 has a first stopper protrusion 422*a* projecting inward of the case receiving groove 424. The first stopper protrusion 422*a* is engaged with a second stopper protrusion 415*a* protruded from the coupling protrusion 415 of the main case 41. To this end, the first stopper protrusion 422*a* and the second stopper protrusion 415*a* may be formed in a hook shape or a shape corresponding to each other.

When the auxiliary case 42 is mounted on the main case 41, the coupling protrusion 415 of the main case 41 is inserted into the case receiving groove 424. At the same time, the first stopper protrusion 422*a* and the second stopper protrusion 415*a* are coupled to each other, so that the main case 41 and the auxiliary case 42 may be firmly coupled and fixed to each other.

The cover 50 may be mounted to the lamp case 40 such that the cover 50 may direct light emitted from the light-emitting unit 60 toward the inner space of the refrigerator. Further, the cover 50 may be combined with the light-emitting unit 60 that emits light. The light-emitting unit 60 may be disposed at a position facing the reflective surface 412*a* of the cavity 412 such that the unit 60 may irradiate light toward the reflective surface 412*a*. Accordingly, the light passing through the cover 50 comes from light reflected from the reflective surface 412*a*, whereby the lighting device 400 may realize planar light emission.

The cover 50 and the light-emitting unit 60 may be coupled to each other. A combination of the cover 50 and the light-emitting unit 60 may be mounted on the lamp case 40. The cover 50 may include the light-emission portion 51 formed in a shape corresponding to the case opening 102*a* and exposed toward the inner space of the refrigerator, and a step portion 52 formed to be stepped at one end of the light-emitting portion 51 and to which the light-emitting unit 60 is mounted. In this way, the cover 50 may have a shape of a front surface exposed to the outside. Further, the cover may include a rib 53 extending vertically along the periphery of the light-emitting portion 51.

The light emitted from the light-emitting unit 60 is reflected from the reflective surface 412*a*, and then the reflected light is transmitted through the light-emission portion 51 to be directed to the inner space of the refrigerator. The light-emission portion 51 may be formed to have substantially the same size as the case opening 102*a*. The light-emitting portion 51 may be exposed toward the inner space of the refrigerator through the case opening 102*a*.

In one embodiment, a reflection portion 56 may be formed on the step portion 52. The reflection portion 56 prevents a portion of the light emitted from the light-emission member 62 from being directly irradiated toward the cover 50. As a result, it is possible to prevent spotlight phenomenon from occurring on the cover 50. To this end, the reflection portion 56 may be formed so that the amount of light may be secured by directing the refracted and/or reflected light toward the light-emission portion 51.

The reflection portion 56 may be configured to reflect light. The reflection portion 57 is formed on the back surface of the step portion 52 by coating a light-reflecting paint, attaching a separate light reflection member thereon, or attaching a light reflection member on the step portion 52 in various ways such as printing, coating, deposition, attachment, bonding, etc. Therefore, although the reflection portion 57 has a planar shape, the reflection portion 57 may reflect a portion of the light emitted from the light-emission member 62 to be directed to the reflective surface 412*a*. The reflection portion 57 may be extend from the position adjacent to the light-emitting unit 60 to the end of the step portion 52.

Most of the light emitted from the light-emission member 62 is reflected by the reflective surface 412*a* and then is directed toward the cover 50. Further, a portion of the light emitted from the light-emission member 62 is directed to an inclined surface of the reflection portion 56. Further, light directed to the reflection portion 56 may be incident on and refracted from the outer surface of the reflection portion 56. Then, the refracted light is directed toward the front of the step portion 52 without being directed to the light-emission portion 51. The front of the step portion 52 is shielded by the auxiliary case 42 or the inner case 102. As a result, the light directed toward the front of the step portion 52 is reflected on the reflective surface 412*a* and is irradiated to the inner space of the refrigerator through the cover 50.

Therefore, all of the light emitted from the light-emission member 62 is the light reflected from the reflective surface 412*a*, and, then, the reflected light passes through the cover. Thus, when viewed from the inner space of the refrigerator, the illumination from the cover 50 realizes the same effect as the indirect illumination and causes the surface light emission. Further, it is possible to prevent local spotlight phenomenon, in particular, occurrence of a spotlight phenomenon on a position corresponding to the light-emission member 62.

The present disclosure may include various other embodiments as well as the foregoing embodiments. In another embodiment of the present disclosure, a lamp case to be coupled to the cover is formed of a single body. Another embodiment of the present disclosure is the same as those as described above except for a configuration of the lamp case. Thus, overlapping descriptions of the same components will be omitted. The same components will be described using the same reference numerals.

FIG. 16 is a cross-sectional view of a lighting device according to still another embodiment of the present disclosure.

As shown in the figure, according to another embodiment of the present disclosure, the lighting device 400 includes a lamp case 40' mounted on the inner case 102, the cover 50 coupled to the lamp case 40' and exposed through the inner case 102 toward the inner space of the refrigerator, and the light-emitting unit 60 mounted on the cover 50.

In the lamp case 40', a cavity 412 is formed in which the light-emitting unit 60 is received.

On the inner surface of the cavity 412, a round reflective surface 412*a* and a pivoting guide portion 412*b* may be formed. The reflective surface 412*a* and the pivoting guide portion 412*b* may be formed respectively on both side surfaces facing each other. The light-emission member 62 may be positioned in a direction facing away or opposite to the reflective surface 412*a*. Accordingly, the light emitted from the light-emission member 62 is reflected by the reflective surface 412*a* and then is directed toward the cover 50.

Further, the pivoting guide portion 412*b* is rounded at a position corresponding to the light-emitting unit 60. When the cover 50 is separated or mounted via pivoting, the pivoting guide portion 412*b* prevents the light-emitting unit 60 mounted on the cover 50 or the cover 50 from interfering with the inner surface of the cavity 412.

The cover receiving groove 414 into which the rib 53 of the cover 50 is inserted may be formed at one end of the lamp case 40'. The rib 53 inserted into the cover receiving groove 414 may be engaged with the inner surface of the cover receiving groove 414 in a hook manner. Further, the main frame 411 may be formed outside the cover receiving groove 414.

Further, on the other side of the lamp case 40' facing the cover receiving groove 414, the blocking portion 417 may be formed. The blocking portion 417 extends toward the step portion 52 of the cover 50. The blocking portion 417 shields the light-emitting unit 60 mounted on the cover 50 and constrains the cover 50 in contact with the cover 50.

An adhesive member 402 may be provided on the main frame 411 and the blocking portion 417. The adhesive member may be applied such that the lamp case 40' is adhered and fixed to the inner case 102.

In one embodiment, the cover 50 may be mounted to the lamp case 40' to shield at least a portion of the cavity 412. The cover 50 may include the light-emission portion 51 configured for passing therethrough light reflected from the reflective surface 412*a*, and the step portion 52 that is shielded by the blocking portion 417 at the side end of the light-emitting portion 51. The light-emission portion 51 has a configuration for realizing diffusion of incident light thereto, and thus the light-emission portion 51 may realize planar light emission. The light-emission portion 51 shields the case opening 102*a*, so that when the user views the inner space of the refrigerator, the entire case opening 102*a* executes planar light emission.

The step portion 52 may be shielded by the blocking portion 417 of the lamp case 40'. Further, the light-emitting unit 60 may be disposed behind the step portion 52. The light-emitting unit 60 may be positioned at the end of the step portion 52, and the step portion 52 may have the reflection portion 54 protruding to have a predetermined curvature.

Most of the light emitted from the light-emission member 62 is reflected by the reflective surface 412*a* and then is directed toward the cover 50. Further, a portion of the light emitted from the light-emission member 62 is directed to an inclined surface of the reflection portion 54. Further, light directed to the reflection portion 54 may be incident on and refracted from the outer surface of the reflection portion 54. Then, the refracted light is directed toward the front of the step portion 52 without being directed to the light-emission portion 51. The front of the step portion 52 is shielded by the lamp case 40'. As a result, the light directed toward the front of the step portion 52 is reflected on the reflective surface 412*a* and is irradiated to the inner space of the refrigerator through the cover 50. Therefore, all of the light emitted from the light-emission member 62 is the light reflected from the reflective surface 412*a*, and, then, the reflected light passes through the cover. Thus, when viewed from the inner space of the refrigerator, the illumination from the cover 50 realizes the same effect as the indirect illumination and causes the surface light emission. Further, it is possible to prevent local spotlight phenomenon, in particular, occurrence of a spotlight phenomenon on a position corresponding to the light-emission member 62.

In the above description, numerous specific details are set forth in order to provide a thorough understanding of the present disclosure. The present disclosure may be practiced without some or all of these specific details. Examples of various embodiments have been illustrated and described above. It will be understood that the description herein is not intended to limit the claims to the specific embodiments described. On the contrary, it is intended to cover alternatives, modifications, and equivalents as may be included within the spirit and scope of the present disclosure as defined by the appended claims.

What is claimed is:

1. A refrigerator comprising:

a cabinet comprising an outer case that defines an outer appearance of the refrigerator and an inner case that defines a storage space of the refrigerator, the inner case defining a case opening; and a lighting device located at the inner case and configured to illuminate light through the case opening, the lighting device comprising:

a lighting case that is located at the inner case, the lighting case defining a cavity recessed outward of the case opening and located at a position corresponding to the case opening, a light-emitting unit that is disposed in the cavity, that faces an inner surface of the cavity, and that is configured to emit light toward the inner surface of the cavity, and a cover that is configured to couple to the lighting case, that is configured to cover the case opening, and that is configured to allow transmission of light reflected from the inner surface of the cavity toward the storage space through the cover, wherein the cover comprises:

a light-emission portion that covers the case opening and that is configured to transmit light reflected from the cavity, and a step portion that extends from an end of the light-emission portion along a longitudinal direction of the cover and that is configured to be covered by the inner case, and wherein the light-emitting unit is mounted on the step portion to be covered by the inner case, and is oriented to emit light in a direction that crosses the longitudinal direction of the cover.

2. The refrigerator according to claim 1, wherein the cover further comprises:

a reflection portion that is located inside the cover and that is configured to, based on reception of light emitted toward the case opening, direct light toward the inner surface of the cavity.

3. The refrigerator according to claim 2, wherein the reflection portion has a round shape that protrudes from an inner surface of the step portion and that is configured to reflect light emitted from the light-emitting unit to the inner surface of the cavity.

4. The refrigerator according to claim 2, wherein the reflection portion has an inclined shape that protrudes from an inner surface of the step portion and that is configured to reflect light emitted from the light-emitting unit to the inner surface of the cavity.

5. The refrigerator according to claim 2, wherein the reflection portion has a round shape or an inclined shape that protrudes from an inner surface of the step portion, wherein the light-emitting unit comprises a light-emission member configured to emit light, and wherein a height of the reflection portion from the inner surface of the step portion is less than a distance from the inner surface of the step portion to an end of the light-emission member.

6. The refrigerator according to claim 2, wherein the reflection portion comprises a reflective layer located at an inner surface of the step portion and configured to reflect, toward the inner surface of the cavity, light emitted from the light-emitting unit.

7. The refrigerator according to claim 2, wherein the reflection portion and the light-emitting unit are located on the step portion at positions that are adjacent to each other, wherein the light-emitting unit is connected to a connector that is configured to connect to a wire that passes through the lighting case, and wherein the light-emitting unit is further configured to detach from the step portion of the cover based on the connector being disconnected from the wire that passes through the lighting case.

8. The refrigerator according to claim 7, wherein the light-emitting unit comprises:

a printed circuit board (PCB) coupled to the lighting case; and a plurality of light-emission members arranged at the PCB and configured to emit light.

9. The refrigerator according to claim 8, wherein the cover further comprises:

a PCB support configured to support the PCB, the PCB support comprising a bent portion that extends along an end of the step portion; and a PCB fixing portion that is spaced apart from the PCB support and that is configured to couple to the PCB based on the PCB being located between the PCB support and the PCB fixing portion.

10. The refrigerator according to claim 9, wherein the lighting case defines a fixing-portion receiving groove that is located at the inner surface of the cavity and that is configured to receive an end of the PCB fixing portion.

11. The refrigerator according to claim 9, wherein the PCB fixing portion comprises a plurality of PCB fixing portions that are arranged along the end of the step portion and that are spaced apart from each other, and wherein the cover further comprises a cover support that extends from the end of the step portion toward the inner surface of the cavity, that is located between the plurality of PCB fixing portions, and that is configured to support the cover.

12. The refrigerator according to claim 9, wherein the PCB support comprises a protrusion that extends outside of the light-emission portion in the longitudinal direction of the cover, wherein the connector is located at the protrusion of the PCB support, wherein the lighting device defines a cable connection space that is located at an end portion of the cavity, that is located outside of the case opening, and that is configured to be covered by the inner case, and wherein the protrusion of the PCB support is configured to insert to the cable connection space.

13. The refrigerator according to claim 9, wherein the lighting case comprises:

a main case that defines the cavity; and an auxiliary case coupled to the main case and configured to cover the step portion of the cover.

14. The refrigerator according to of claim 13, wherein the main case and the auxiliary case, based on coupling to each other, define a frame that extends along a circumference of the lighting case and that surrounds at least a portion of the case opening, wherein the main case has a first surface that is configured to couple to an outer surface of the inner case, and wherein the auxiliary case has a second surface that is configured to couple to the outer surface of the inner case and that is coplanar with the first surface.

15. The refrigerator according to of claim 13, wherein the auxiliary case is configured to, based on the cover coupling to the inner case, contact the step portion and be positioned between the step portion and at least a portion of the inner case.

16. The refrigerator according to claim 1, wherein the lighting device further comprises a reflective surface located at the inner surface of the cavity and configured to direct, toward the cover, light emitted from the light-emitting unit, and wherein the light-emitting unit is oriented in a direction facing the reflective surface.

17. The refrigerator according to claim 1, wherein the lighting case is coupled to an outer surface of the inner case, and wherein the cover is configured to insert into the cavity from the storage space through the case opening in a state in which the light-emitting unit is mounted on the step portion.

18. The refrigerator according to claim 17, wherein the cover comprises:

a first portion that comprises the step portion, that extends along a front side of the case opening, and that is coupled to the front side of the case opening; and a second portion that faces a rear side of the case opening and that extends rearward of the case opening, the second portion comprising a rib configured to insert into the inner case, and wherein the inner case defines a cover receiving groove that is located rearward of the case opening and that is configured to receive the rib located at the second portion of the cover.

19. The refrigerator according to claim 18, wherein the inner surface of the cavity has a curvature that allows the step portion of the cover to pivot about the front side of the case opening without interfering with the inner surface of the cavity based on the rib being disengaged from the cover receiving groove.

20. The refrigerator according to claim 17, wherein the lighting device defines a cable connection space that is located at an end portion of the cavity, that is located outward of the case opening, and that is configured to be covered by the inner case, and wherein the cable connection space is configured to receive an electric wire and a connector connected to the electric wire and allows the electric wire and the connector to pass through the lighting case and connect to the light-emitting unit.

* * * * *